US012188110B2

(12) United States Patent
Yoshida et al.

(10) Patent No.: US 12,188,110 B2
(45) Date of Patent: Jan. 7, 2025

(54) STEEL MATERIAL SUITABLE FOR USE IN SOUR ENVIRONMENT

(71) Applicant: NIPPON STEEL CORPORATION, Tokyo (JP)

(72) Inventors: Shinji Yoshida, Tokyo (JP); Yuji Arai, Tokyo (JP); Kuniaki Itoh, Tokyo (JP); Takuya Okamura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 628 days.

(21) Appl. No.: 17/596,474

(22) PCT Filed: Aug. 13, 2020

(86) PCT No.: PCT/JP2020/030828
§ 371 (c)(1),
(2) Date: Dec. 10, 2021

(87) PCT Pub. No.: WO2021/039431
PCT Pub. Date: Mar. 4, 2021

(65) Prior Publication Data

US 2022/0325393 A1 Oct. 13, 2022

(30) Foreign Application Priority Data

Aug. 27, 2019 (JP) ..... 2019-154252
Aug. 27, 2019 (JP) ..... 2019-154359

(51) Int. Cl.
*C22C 38/42* (2006.01)
*C22C 38/00* (2006.01)
(Continued)

(52) U.S. Cl.
CPC ..... *C22C 38/54* (2013.01); *C22C 38/001* (2013.01); *C22C 38/02* (2013.01); *C22C 38/04* (2013.01);
(Continued)

(58) Field of Classification Search
CPC ..... C22C 38/42
See application file for complete search history.

(56) References Cited

U.S. PATENT DOCUMENTS 6,267,828 B1 * 7/2001 Kushida ..... C21D 6/02 148/334
10,844,453 B2 * 11/2020 Yuga ..... C22C 38/24
(Continued)

FOREIGN PATENT DOCUMENTS

JP 2000297344 A 10/2000
JP 2001271134 A 10/2001
(Continued)

*Primary Examiner* — Christopher S Kessler
(74) *Attorney, Agent, or Firm* — Greer Burns & Crain Ltd.

(57) ABSTRACT

The steel material according to the present disclosure has a chemical composition consisting of, in mass %, C: more than 0.20 to 0.35%, Si: 0.05 to 1.00%, Mn: 0.02 to 1.00%, P: 0.025% or less, S: 0.0100% or less, Al: 0.005 to 0.100%, Cr: 0.40 to 1.50%, Mo: 0.30 to 1.50%, Ti: 0.002 to 0.050%, B: 0.0001 to 0.0050%, N: 0.0100% or less and O: 0.0100% or less, with the balance being Fe and impurities, and satisfies Formula (1) and Formula (2) described in the description. The yield strength is 862 MPa or more. A numerical proportion of precipitates having an equivalent circular diameter within a range of 20 to 300 nm among precipitates having an equivalent circular diameter of 20 nm or more in the steel material is 0.85 or more.

17 Claims, 3 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/54*** | (2006.01) |

(52) U.S. Cl.
CPC ..... *C22C 38/06* (2013.01); *C22C 38/42* (2013.01); *C22C 38/44* (2013.01)

(56) References Cited

U.S. PATENT DOCUMENTS

| | | | | |
|---|---|---|---|---|
| 2009/0047166 | A1 | 2/2009 | Tomomatsu et al. | |
| 2017/0306461 | A1 * | 10/2017 | Kondo | C22C 38/02 |

FOREIGN PATENT DOCUMENTS

| | | | |
|---|---|---|---|
| JP | 2012026030 | A | 2/2012 |
| WO | 2008123422 | A1 | 10/2008 |

* cited by examiner

STEEL MATERIAL SUITABLE FOR USE IN SOUR ENVIRONMENT

TECHNICAL FIELD

The present disclosure relates to a steel material, and more particularly relates to a steel material suitable for use in a sour environment.

BACKGROUND ART

Due to the deepening of oil wells and gas wells (hereunder, oil wells and gas wells are collectively referred to as "oil wells"), there is a demand to enhance the strength of oil-well steel materials represented by oil-well steel pipes. Specifically, 80 ksi grade (yield strength is 80 to less than 95 ksi, that is, 552 to less than 655 MPa) and 95 ksi grade (yield strength is 95 to less than 110 ksi, that is, 655 to less than 758 MPa) oil-well steel pipes are being widely utilized, and recently requests are also starting to be made for 110 ksi grade (yield strength is 110 to less than 125 ksi, that is, 758 to less than 862 MPa), 125 ksi grade (yield strength is 125 to less than 140 ksi, that is, 862 to less than 965 MPa) and 140 ksi or more (yield strength is 140 ksi or more, that is, 965 MPa or more) oil-well steel pipes.

In recent years, deep wells beneath the surface of the sea are also being actively developed. For example, in so-called "deep-sea offshore oil fields" that are at a water depth of 2000 m or more, the water temperature is low. Steel materials that are used in such severe environments are required to have not only high strength, but also low-temperature toughness. However, if the yield strength of a steel material is increased excessively, there is a concern that the low-temperature toughness of the steel material will decrease.

Furthermore, most deep wells are in a sour environment containing corrosive hydrogen sulfide. In the present description, the term "sour environment" means an acidified environment containing hydrogen sulfide. Note that, in some cases a sour environment ma also contain carbon dioxide. Oil-well steel pipes for use in such sour environments are required to have not only high, strength, but to also have sulfide stress cracking resistance (hereunder, referred to as "SSC resistance"). Thus, a steel material which has high strength and excellent low-temperature toughness and also has excellent SSC resistance has started to be demanded.

Technology for increasing the low-temperature toughness and SSC resistance of steel materials as typified by oil-well steel pipes is proposed in Japanese Patent Application Publication No. 2000-297344 (Patent Literature 1), Japanese Patent Application Publication No. 2001-271134 (Patent Literature 2), and International Application Publication No. WO2008/123422 (Patent Literature 3).

A steel for oil wells that is disclosed in Patent Literature 1 contains, in mass %. C: 0.15 to 0.3%, Cr: 0.2 to 1.5%, Mo: 0.1 to 1%, V: 0.05 to 0.3%, and Nb: 0.003 to 0.1%. In this steel for oil wells, the amount of precipitating carbides is within the range of 1.5 to 4% by mass, the proportion that MC-type carbides occupy among the amount of carbides is within the range of 5 to 45% by mass, and when the wall thickness of the product is taken as t (mm), the proportion of $M_{23}C_6$-type carbides is (200/t) or less in percent by mass. It is described in Patent Literature 1 that the aforementioned steel for oil wells is excellent in toughness and SSC resistance.

A low-alloy steel material that is disclosed in Patent Literature 2 consists of in mass %, C: 0.2 to 0.35%, Si: 0.05 to 0.5%, Mn: 0.1 to 1%, P: 0.025% or less, S: 0.01% or less, Cr: 0.1 to 1.2%, Mo: 0.1 to 1%, B: 0.0001 to 0.005%, Al: 0.005 to 0.1%, N: 0.01% or less, V: 0.05 to 0.5%, Ni: 0.1% or less, W: 1.0% or less and O: 0.01% or less, with the balance being Fe and impurities, and satisfies the formula ($0.03 \leq Mo \times V \leq 3$) and the formula ($0.5 \times Mo - V + GS/10 \geq 1$) and has a yield strength of 1060 MPa or more. Note that, "GS" in the formula represents the ASTM grain size number of prior-austenite grains. It is described in Patent Literature 2 that the aforementioned low-alloy steel material is excellent in SSC resistance and toughness.

A low-alloy steel disclosed in Patent Literature 3 consists of, in mass %, C: 0.10 to 0.20%, Si: 0.05 to 1.0%, Mn: 0.05 to 1.5%, Cr: 1.0 to 2.0%, Mo: 0.05 to 2.0%, Al: 0.10% or less and Ti: 0.002 to 0.05%, with Ceq (=C+(Mn/6)+(Cr+Mo+V)/5) being 0.65 of more, and with the balance being Fe and impurities, and among, the impurities the low-alloy steel contains P: 0.025% or less, S: 0.010% or less, N: 0.007% or less, and B: less than 0.0003%. In the low-alloy steel, the amount of $M_{23}C_6$-type precipitates having a grain size of 1 μm or more is not more than 0.1 per $mm^2$. It is described in Patent Literature 3 that in the low-alloy steel, toughness is secured and SSC resistance is enhanced.

CITATION LIST

Patent Literature

Patent Literature 1: Japanese Patent Application Publication No, 2000-297344

Patent Literature 2: Japanese Patent Application Publication No, 2001-271134

Patent Literature 31 International Application. Publication No. WO 2008/123422

SUMMARY OF INVENTION

Technical Problem

As described above, in recent years, accompanying the increasing severity of oil well environments, there is a demand for steel materials having a yield strength of 125 ksi or more, more excellent low-temperature toughness and more excellent SSC resistance than heretofore. Therefore, a steel material (for example, a steel material for oil wells) having a yield strength of 125 ksi or more (862 MPa or more), excellent low-temperature toughness and excellent SSC resistance may be obtained by techniques other than the techniques disclosed in the aforementioned Patent Literatures 1 to 3.

An objective of the present disclosure is to provide a steel material that has a yield strength of 862 MPa or more (125 ksi or more), excellent low-temperature toughness and excellent SSC resistance.

Solution to Problem

A steel material according to the present disclosure contains a chemical composition consisting of, in mass %, C: more than 0.20 to 0.35%, Si: 0.05 to 1.00%.

Mn: 0.02 to 1.00%,

P: 0.025% or less,

S: 0.0100% or less,

Al: 0.005 to 0.100%,

Cr: 0.40 to 1.50%,

Mo: 0.30 to 1.50%,

Ti: 0.002 to 0.050%,
B: 0.0001 to 0.0050%,
N: 0.0100% or less,
O: 0.0100% or less,
V: 0 to 0.60%,
Nb: 0 to 0.030%,
Ca: 0 to 0.0100%,
Mg: 0 to 0.0100%,
Zr: 0 to 0.0100%,
rare earth metal: 0 to 0.0100%,
Co: 0 to 0.50%,
W: 0 to 0.50%,
Ni: 0 to 0.10%,
Cu: 0 to 0.50%, and
with the balance being Fe and impurities, and
a yield strength of 862 MPa or more, wherein the steel material satisfies Formula (1) and Formula (2), in the steel material, a numerical proportion of precipitates having an equivalent circular diameter within a range of 20 to 300 nm among precipitates having an equivalent circular diameter of 20 nm or more is (185 or more:

$$(0.157\times C-0.0006\times Cr-0.0098\times Mo-0.0482\times V+0.0006)/\theta_{Cr}\leq 0.300 \quad (1)$$

$$(1+263\times C-Cr-16\times Mo-80\times V)/(98-358\times C+159\times Cr+15\times Mo+96\times V)\leq 0.355 \quad (2)$$

where, a content in mass % of a corresponding element is substituted for each symbol of an element in Formula (1) and Formula (2), and if a corresponding element is not contained, "0" is substituted for the symbol of the relevant element, and a Cr concentration in mass fraction in precipitates having an equivalent circular diameter of 20 nm or more is substituted for $\theta_{Cr}$ in Formula (1).

Advantageous Effects of Invention

The steel material according to the present disclosure has a yield strength of 862 MPa or more (125 ksi or more) and has excellent low-temperature toughness and excellent SSC resistance.

BRIEF DESCRIPTION OF DR WINGS

DESCRIPTION OF EMBODIMENTS

The present inventors conducted investigations and studies regarding a method for obtaining a yield strength of 862 MPa or more (125 ksi or more), excellent low-temperature toughness and excellent SSC resistance in a steel material that will assumedly be used, in a sour environment, and obtained the following findings.

First, the present inventors focused on the chemical composition, and conducted detailed studies regarding a steel material having a yield strength of 125 ksi or more, excellent low-temperature toughness and excellent SSC resistance. As a result, the present inventors considered that if a steel material has a chemical composition consisting of, in mass %, C: more than 0.20 to 0.35%, Si: 0.05 to 1.00%, Mn: 0.02 to 1.00%, P: 0.025% or less, S: 0.0100% or less, Al: 0.005 to 0.100%, Cr: 0.40 to 1.50%, Mo: 0.30 to 1.50%, 0.002 to 0.050%, B: 0.0001 to 0.0050%, N: 0.0100% or less, O: 0.0100% or less, V: 0 to 0.60%, Nb: 0 to 0.030%, Ca: 0 to 0.0100%, Mg: 0 to 0.0100%, Zr: 0 to 0.0100%, rare earth metal: 0 to 0.0100%, Co: 0 to 0.50%, W: 0 to 0.50%, Ni: 0 to 0.10%, and, Cu: 0 to 0.50% with the balance being Fe and impurities, there is a possibility of obtaining a yield strength of 125 ksi or more, excellent low-temperature toughness and excellent SSC resistance.

Therefore, the present inventors conducted various studies regarding factors that decrease low-temperature toughness and SSC resistance in a steel material having the aforementioned chemical composition. As a result, the present inventors discovered that coarse carbides are liable to precipitate in a steel material having the aforementioned chemical composition. When coarse precipitates (including carbides) precipitate in a large amount in a steel material, stress concentration is liable to occur at interfaces between the coarse precipitates and the base metal. As a result, there is a possibility that the low-temperature toughness and SSC resistance of the steel material will decrease.

On the other hand, heretofore sufficient studies have not been conducted with regard to the distribution of the size of precipitates in a steel material having the aforementioned chemical composition. That is, heretofore what size of precipitates precipitating at which number density cause the low-temperature toughness and SSC resistance of a steel material to decrease has not been clarified.

Figure 1:
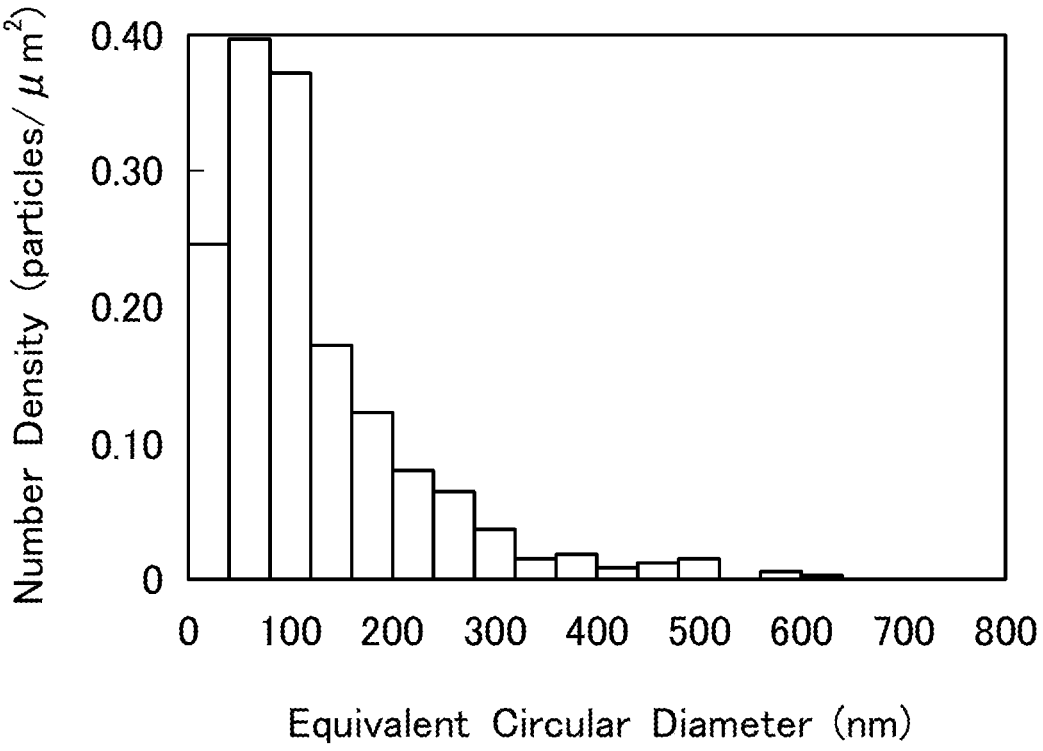
FIG. 1 is a schematic diagram illustrating the relation between the equivalent circular diameter and number density of precipitates with respect to one example of a steel material having the chemical composition of the present embodiment.
Figure 2:
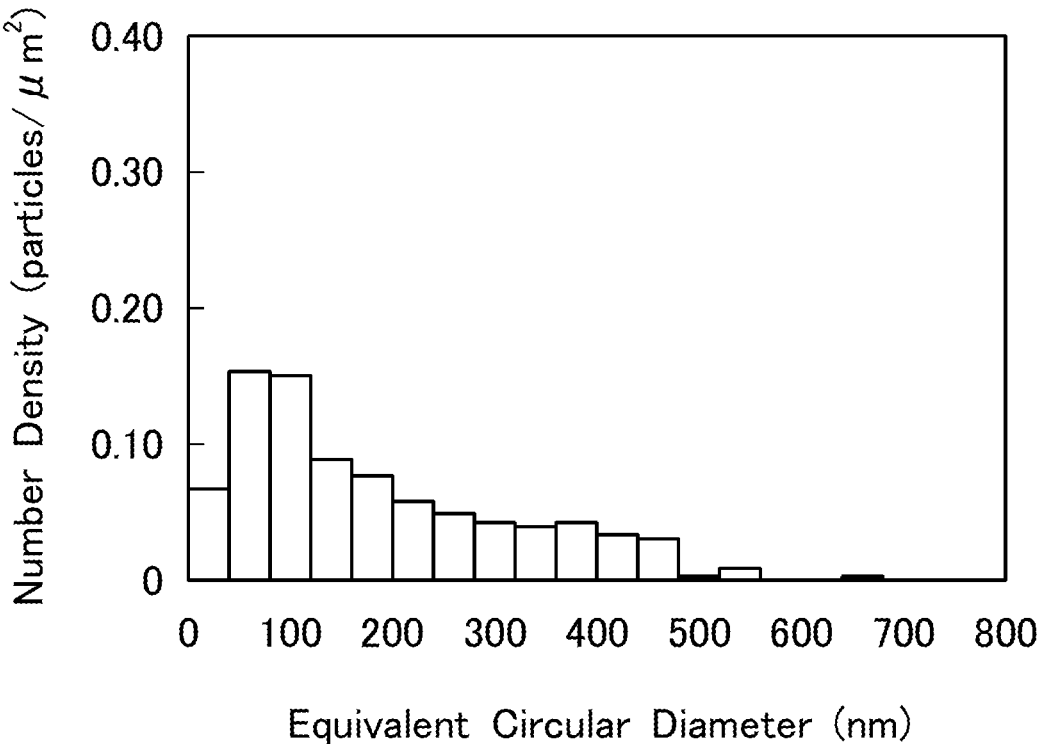
FIG. 2 is a schematic diagram illustrating the relation between the equivalent circular diameter and number density of precipitates with respect to another example of a steel material having the chemical composition of the present embodiment.

Therefore, first, the present inventors conducted detailed studies regarding precipitates of a steel material having the aforementioned chemical composition. FIG. 1 is a histogram illustrating the relation between the equivalent circular diameter and number density of precipitates included in the steel material, with respect to one example of a steel material having the aforementioned chemical composition. FIG. 2 is a histogram illustrating the relation between the equivalent circular diameter and number density of precipitates included in the steel material, with respect to another example of a steel material having the aforementioned chemical composition. Note that, in the present description, the term "equivalent circular diameter" means the diameter of a circle in a case where the area of a precipitate observed on a visual field surface during micro-structure observation is converted into a circle having the same area.

The equivalent circular diameter and number density of precipitates in FIG. 1 and FIG. 2 were determined by methods that are described later. Specifically, the equivalent circular diameter and number density of the precipitates were determined using an area fraction S (%) of the precipitates obtained by thermodynamic calculation that is described later, and a three-dimensional roughness profile that is described later. Note that the precipitates which were taken as the object for determining the equivalent circular diameter and the number density were precipitates having an equivalent circular diameter of 20 nm or more. Further, the histograms illustrated in FIG. 1 and FIG. 2 were created taking the class width as 40 nm.

Referring to FIG. 1 and FIG. 2, the distribution states of precipitates of steel materials having the aforementioned chemical composition are as follows. Precipitates having an equivalent circular diameter within the range of 40 to 80 nm have the largest number density among precipitates having an equivalent circular diameter of 20 nm or more. The number density of the precipitates gradually decreases as the equivalent circular diameter increases. In addition, with respect to the region in which the equivalent circular diameter is large, almost no precipitates that have an equivalent circular diameter of 500 nm or more are confirmed.

Furthermore, referring to FIG. 1 and FIG. 2, in the steel material shown in FIG. 2, the number density of coarse precipitates increases more than in the steel material shown in FIG. 1. However, referring to FIG. 1 and FIG. 2, a significant variation is not confirmed with regard to the number density of coarse precipitates having an equivalent circular diameter of more than 300 nm. It was thus clarified by detailed studies of the present inventors that, in a steel material having the aforementioned chemical composition, in a case where the number density of coarse precipitates increases, there is, in contrast, a noticeable decrease in the number density of precipitates having an equivalent circular diameter of 300 area or less.

The reason for the above situation has not been clarified in detail. However, the present inventors consider that the reason is as follows. In a steel material having the aforementioned chemical composition, almost all of the precipitates having an equivalent circular diameter of 20 nm or more are cementite. In a steel material having the aforementioned chemical composition, cementite is liable to coarsen due to Ostwald growth in a tempering process that is described later. During Ostwald growth, a single coarse cementite particle is formed from a plurality of fine cementite particles in the steel material. It is considered that, due to this mechanism, the number density of precipitates having an equivalent circular diameter of more than 300 nm increases, and the number density of precipitates having an equivalent circular diameter within the range of 20 to 300 nm noticeably decreases.

Based on the above findings, the present inventors have found that if focusing on the distribution states of precipitates of steel materials, it can be an index that indicates the coarse precipitates in the steel material, and there is a possibility of increasing a low-temperature toughness and SSC resistance. Therefore, the present inventors focused on the proportion that precipitates having an equivalent circular diameter within the range of 20 to 300 nm occupy among precipitates having an equivalent circular diameter of 20 nm or more, and not on the number density of the precipitates. If the proportion that precipitates having an equivalent circular diameter within the range of 20 to 300 nm occupy among the number of precipitates that have an equivalent circular diameter of 20 nm or more in a steel material having the aforementioned chemical composition can be increased, there is a possibility that the number density of precipitates having an equivalent circular diameter of more than 300 nm will be sufficiently reduced and the low-temperature toughness and the SSC resistance of the steel material will be enhanced.

Therefore, the present inventors conducted detailed studies regarding the numerical proportion of precipitates having an equivalent circular diameter within the range of 20 to 300 nm among precipitates having an equivalent circular diameter of 20 nm or more (hereinafter, also referred to as "numerical proportion of fine precipitates $NP_F$") in a steel material having the aforementioned chemical composition as well as the low-temperature toughness and the SSC resistance of the steel material. Specifically, among the steel materials having a yield strength of 862 MPa or more, regarding to each of the steel material having a yield strength of less than 965 MPa and the steel material having a yield strength of 965 MPa or more, the present inventors conducted detailed studies about the relation between the numerical proportion of fine precipitates, the low-temperature toughness and the SSC resistance. It will be described using a drawing.

Figure 3:
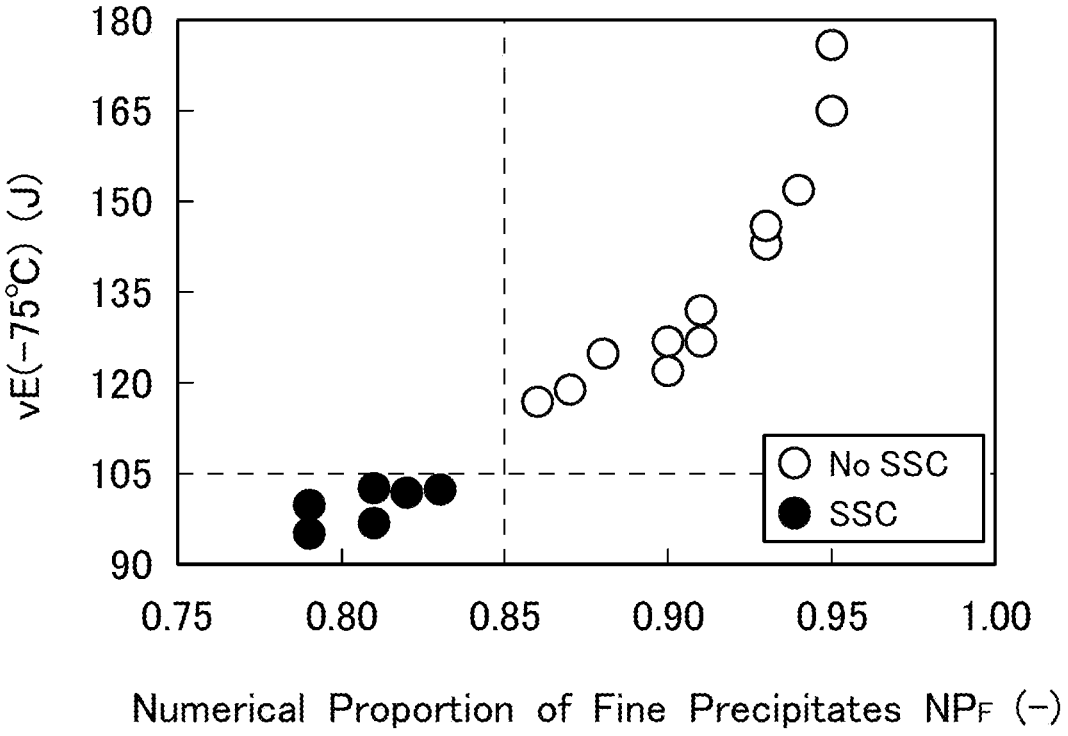
FIG. 3 is a view illustrating the relation between the numerical proportion of fine precipitates $NP_F$, low-temperature toughness and SSC resistance with respect to a steel material having a yield strength of 125 ksi grade.

FIG. 3 is a view that illustrates the relation between the numerical proportion of fine precipitates $NP_F$, the low-temperature toughness and the SSC resistance for the steel materials having a yield strength of 125 ksi grade (862 to less than 965 MPa) among the examples that are described later. FIG. 3 was obtained by the following method. With respect to steel materials having the aforementioned chemical composition and a yield strength within the range of 862 to less than 965 MPa (125 ksi grade) among examples that are described later, FIG. 3 was created using the obtained numerical proportions of fine precipitates $NP_F$, an absorbed energy vE(−75° C.)(J) at −75° C. that is an index of low-temperature toughness, and evaluation results for SSC resistance that were evaluated by a method that is described later.

The numerical proportion of fine precipitates $NP_F$ was determined by a method that is described later. Further, with regard to the low-temperature toughness, it was determined that the steel material in question had excellent low-temperature toughness in a case where the absorbed energy vE(−75° C.) at −75° C. obtained in a Charpy impact test that is described later was 105 J or more. In addition, the symbol "○" in FIG. 3 indicates a steel material that had excellent SSC resistance. On the other hand, the symbol "●" in FIG. 3 indicates a steel material that did not exhibit excellent SSC resistance.

Referring to FIG. 3, it was clarified that, in the steel material having the aforementioned chemical composition and the yield strength of 125 ksi grade (862 to less than 965 MPa), if the numerical proportion of fine precipitates $NP_F$ is 0.85 or more, the steel material exhibits excellent low-temperature toughness and also exhibits excellent SSC resistance. On the other hand, in a steel material having the aforementioned chemical composition and the yield strength of 125 ksi grade, if the numerical proportion of fine precipitates is less than 0.85, the steel material does not exhibit excellent low-temperature toughness and also does not exhibit excellent SSC resistance.

Figure 4:
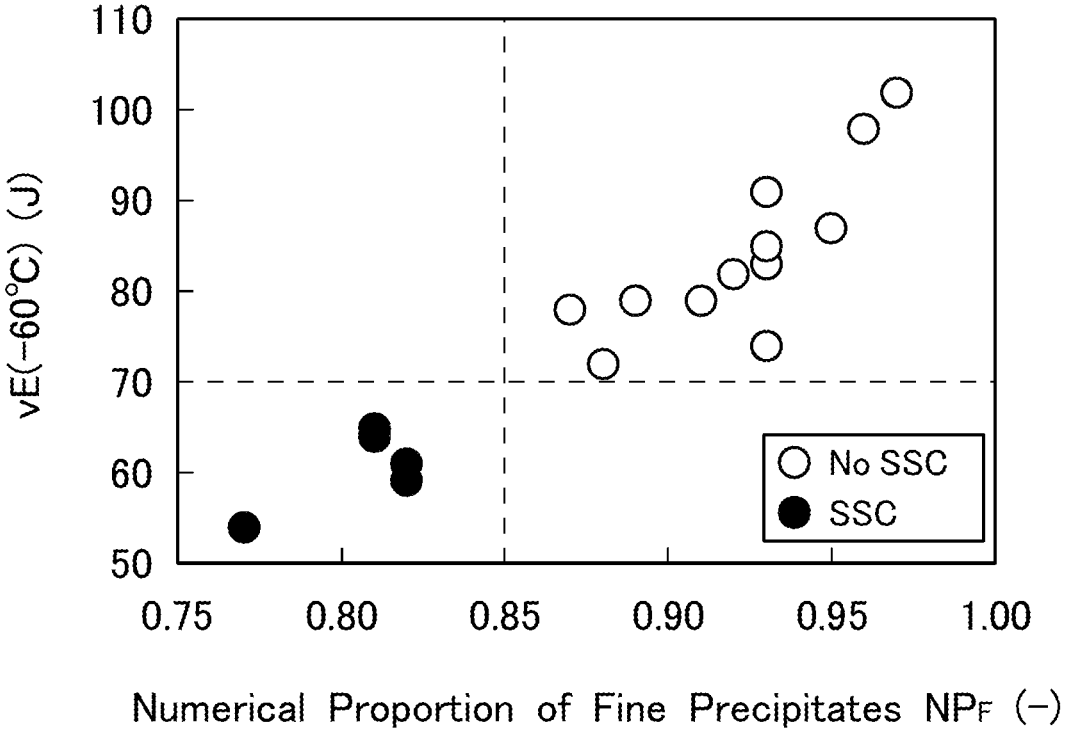
FIG. 4 is a view illustrating the relation between the numerical proportion of fine precipitates $NP_F$, low-temperature toughness and SSC resistance with respect to a steel material having a yield strength of 140 ksi or more.

FIG. 4 is a view that illustrates the relation between the numerical proportion of fine precipitates $NP_F$, the low-temperature toughness and the SSC resistance for the steel materials having a yield strength of 140 ksi or more (965

MPa or more) among the examples that are described later. FIG. 4 was obtained by the following method. With respect to steel materials having the aforementioned chemical composition and a yield strength within the range of 965 MPa or more (140 ksi or more) among examples that are described later. FIG. 4 was created using the obtained numerical proportions of fine precipitates $NP_F$; an absorbed energy vE(−60° C.)(J) at −60° C. that is an index of low-temperature toughness, and evaluation results for SSC resistance that were evaluated by a method that is described later.

The numerical proportion of fine precipitates $NP_F$ was determined by a method, that is described later. Further, with regard to the low-temperature toughness, it was determined that the steel material in question had excellent low-temperature toughness in a case where the absorbed energy vE(−60° C.) at −60° C. obtained in a Charpy impact test that is described later was 70 J or more. In addition, the symbol "○" in FIG. 4 indicates a steel material, that had excellent SSC resistance. On the other hand, the symbol "●" in FIG. 4 indicates a steel material that did not exhibit excellent SSC resistance.

Referring to FIG. 4, it was clarified that, in the steel material having the aforementioned chemical composition and the yield strength of 140 ksi or more (965 MPa or more), if the numerical proportion of fine precipitates $NP_F$ is 0.85 or more, the steel material exhibits excellent low-temperature toughness and also exhibits excellent SSC resistance. On the other hand, in a steel material having the aforementioned chemical composition and the yield strength of 140 ksi or more, if the numerical proportion of fine precipitates is less than 0.85, the steel material does not exhibit excellent ow-temperature toughness and also does not exhibit excellent SSC resistance.

Referring to FIG. 3 and FIG. 4, in the steel material having the aforementioned chemical composition, if the numerical proportion of fine precipitates $NP_F$ is 0.85 or more, the steel material has the yield strength of 862 MPa or more, exhibits excellent low-temperature toughness and also exhibits excellent SSC resistance. Therefore, the steel material according to the present embodiment has the aforementioned chemical composition and, furthermore, the numerical proportion of fine precipitates $NP_F$ in the steel material is 0.85 or more. Next, the present inventors conducted various studies regarding methods for consistently making the numerical proportion of fine precipitates $NP_F$ 0.85 or more in a steel material having the aforementioned chemical composition.

As a result, the present inventors discovered that the numerical proportion of fine precipitates $NP_F$ is increased if the chemical composition of the steel material and the chromium (Cr) concentration in precipitates satisfy Formula (1).

$$(0.157\times C-0.0006\times Cr-0.0098\times Mo-0.0482\times V+0.0006)/\theta_{Cr}\leq 0.300 \quad (1)$$

Where, a content in mass % of a corresponding element is substituted for each symbol of an element in Formula (1). If a corresponding element is not contained, "0" is substituted for the symbol of the relevant element. Further, the Cr concentration in mass fraction in precipitates having an equivalent circular diameter of 20 nm or more is substituted for $\theta_{Cr}$ in Formula (1).

It is defined that $Fn1=(0.157\times C-0.0006\times Cr-0.0098\times Mo-0.0482\times V+0.0006)/\theta_{Cr}$. The numerator of Fn1 is an index of the total precipitation amount of cementite. The denominator $\theta_{Cr}$ of Fn1 is the Cr concentration (unit: mass fraction) in precipitates having an equivalent circular diameter of 20 nm or more.

As described above, it is considered that in, a steel material having the aforementioned chemical composition, precipitates having an equivalent circular diameter of 20 nm or more are mostly cementite, and the dominant growth mechanism thereof is Ostwald growth. That is, the numerical proportion of fine precipitates $NP_F$ can be increased if Ostwald growth of cementite can be suppressed.

In the case of Ostwald growth, after precipitation of cementite is completed, fine cementite particles dissolve in the matrix, and comparatively large cementite particles grow further. That is, if dissolution of fine cementite particles in the matrix can be suppressed, there is a possibility that coarsening of cementite can be suppressed. In this regard, Cr concentrates in cementite, and stabilizes the cementite. That is, it becomes difficult for cementite in which the Cr concentration is high to dissolve in the steel material. It is considered that, as a result, Ostwald growth of cementite is suppressed.

That is, the Cr concentration $\theta_{Cr}$ in precipitates having an equivalent circular diameter of 20 nm or more that is the denominator of Fn1 is an index that indicates the degree of difficulty of Ostwald growth of cementite. The larger that the denominator ($\theta_{Cr}$) of Fn1 is, the greater the possibility of increasing the numerical proportion of fine precipitates $NP_F$ in the steel material. In addition, in a steel material having the aforementioned chemical composition, the larger that the total precipitation amount of cementite is, the easier it is for coarse cementite to be formed. That is, if the numerator of Fn1 is reduced, there is a possibility that the numerical proportion of fine precipitates $NP_F$ will be increased.

In short, Fn1 is an index relating to the numerical proportion of fine precipitates $NP_F$ in the steel material. As long as the other conditions of the present embodiment are satisfied and Fn1 is not more than 0.300, the numerical proportion of fine precipitates $NP_F$ in the steel material can be increased to 0.85 or more. Therefore, in the steel material according to the present embodiment, Fn1 is not more than 0.300.

The present inventors also studied methods for increasing the Cr concentration $\theta_{Cr}$ in precipitates having an equivalent circular diameter of 20 nm or more. As a result, the present inventors discovered that if the aforementioned chemical composition satisfies the following Formula (2), the Cr concentration $\theta_{Cr}$ in precipitates having an equivalent circular diameter of 20 nm or more is increased.

$$(1+263\times C-Cr-16\times Mo-80\times V)/(98-358\times C+159\times Cr+15\times Mo+96\times V)\leq 0.355 \quad (2)$$

Where, a content in mass % of a corresponding element is substituted for each symbol of an element in Formula (2). If a corresponding element is not contained, "0" is substituted for the symbol of the relevant element.

It is defined that $Fn2=(1+263\times C-Cr-16\times Mo-80\times V)/(98-358\times C+159\times Cr+15\times Mo+96\times V)$. Fn2 is an index that indicates the degree to which it is difficult for Cr to concentrate in precipitates. If Fn2 is not more than 0.355, Cr concentrates sufficiently in precipitates and it is easy to suppress Ostwald growth of cementite. Therefore, in the steel material according to the present embodiment, Fn2 is not more than 0.355.

Thus, the steel material according to the present embodiment has the aforementioned chemical composition, and satisfies the conditions that Fn1 is not more than 0.300 and Fn2 is not more than 0.355, and furthermore, the numerical proportion of fine precipitates $NP_F$ is 0.85 or more. As a result, the steel material according to the present embodiment has a yield strength of 125 ksi or more, excellent low-temperature toughness and excellent SSC resistance.

The steel material according to the present embodiment that was completed based on the above findings has the following configuration.

[1]

A steel material comprising a chemical composition consisting of, in mass %,

C: more than 0.20 to 0.35%,

Si: 0.05 to 1.00%,

Mn: 0.02 to 1.00%,

P: 0_025% or less,

S: 0.0100% or less,

Al: 0.005 to 0.100%,

Cr: 0.40 to 1.50%,

Mo: 0.30 to 1.50%,

Ti: 0.002 to 0.050%,

B: 0.0001 to 0.0050%,

N: 0.0100% or less.

O: 0.0100% or less,

V: 0 to 0.60%.

Nb: 0 to 0.030%,

Ca: 0 to 0.0100%,

Mg: 0 to 0.0100%,

Zr: 0 to 0.0100%, rare earth metal: 0 to 0.0100%,

Co: 0 to 0.50%,

W: 0 to 0.50%,

Ni: 0 to 0.10%,

Cu: 0 to 0.50%, and with the balance being Fe and impurities, and a yield strength of 862 MN or more, wherein the steel material satisfies Formula (1) and Formula in the steel material, a numerical proportion of precipitates having an equivalent circular diameter within a range of 20 to 300 nm among precipitates having an equivalent circular diameter of 20 nm or more is 0.85 or more:

$$(0.157\times C-0.0006\times Cr-0.0098\times Mo-0.0482\times V+0.0006)/\theta_{Cr}\leq 0.300 \quad (1)$$

$$(1+263\times C-Cr-16\times Mo-80\times V)/(98-358\times C+159\times Cr+15\times Mo+96\times V)\leq 0.355 \quad (2)$$

where, a content in mass % of a corresponding element is substituted for each symbol of an element in Formula (1) and Formula (2), and if a corresponding element is not contained, "0" is substituted for the symbol of the relevant element, and a Cr concentration in mass fraction in precipitates having an equivalent circular diameter of 20 nm or more is substituted for $\theta_{Cr}$ in Formula (1).

[2]

The steel material according to [1], wherein the chemical composition contains one or more types of elements selected from the group consisting of V: 0.01 to 0.60%, and Nb: 0.002 to 0.030%.

[3]

The steel material according to [1] or [2], wherein the chemical composition contains one or more types of elements selected from the group consisting of Ca: 0.0001 to 0.0100%, Mg: 0.0001 to 0.0100%, Zr: 0.0001 to 0.0100%, and rare earth metal: 0.0001 to 0.0100%.

[4]

The steel material according to any one of [1] to [3], wherein the chemical composition contains one or more types of elements selected from the group consisting of:

Co: 0.02 to 0.50%, and

W: 0.02 to 0.50%.

[5]

The steel material according to any one of [1] to [4], wherein the chemical composition contains one or more types of elements selected from the group consisting of:

Ni: 0.01 to 0.10%, and

Cu: 0.01 to 0.50%.

[6]

The steel material according to any one of [1] to [5], wherein:

the steel material is an oil-well steel pipe.

In the present description, the oil-well steel pipe may be a steel pipe that is used for a line pipe or may be a steel pipe used for oil country tubular goods. The oil-well steel pipe may be a seamless steel pipe or may be a welded steel pipe. The oil country tubular goods are, for example, steel pipes that are used for use in casing or tubing.

Preferably, an oil-well steel pipe according to the present embodiment is a seamless steel pipe. If the oil-well steel pipe according to the present embodiment is a seamless steel pipe, even if the wall thickness thereof is 15 mm or more, the oil-well steel pipe has a yield strength of 862 MPa or more (125 ksi or more), has excellent low-temperature toughness and has excellent SSC resistance.

Hereunder, the steel material according to the present invention is described in detail. The symbol "%" in relation to an element means "mass percent" unless specifically stated otherwise.

[Chemical Composition]

The chemical composition of the steel material according to the present invention contains the following, elements.

C: More than 0.20 to 0.35%

Carbon (C) enhances the hardenability of the steel material and increases the strength of the steel material. C also promotes spheroidization of carbides during tempering in the production process, and thereby enhances the SSC resistance of the steel material. If carbides are dispersed, the strength of the steel material increases further. If the C content is too low, the aforementioned effects cannot not be sufficiently obtained, even when the contents of other elements are within the range of the present embodiment. On the other hand, if the C content is too high, too many carbides will be produced and the low-temperature toughness of the steel material will decrease, even when the contents of other elements are within the range of the present embodiment. In addition, if the C content is too high, quench cracking is liable to occur during quenching in the production process in some cases. Therefore, the C content is within the range of more than 0.20 to 0.35%. A preferable lower limit of the C content is 0.22%, more preferably is 0.24%, and further preferably is 0.26%. A preferable upper limit of the C content is 0.32%, Si: 0.05 to 1.00%

Silicon (Si) deoxidizes the steel. If the Si content is too low, the aforementioned effect cannot be sufficiently obtained, even when the contents of other elements are within the range of the present embodiment. On the other hand, if the Si content is too high, the SSC resistance of the steel material decreases, even when the contents of other elements are within the range of the present embodiment.

Therefore, the Si content is within the range of 0.05 to 1.00%. A preferable lower limit of the Si content is 0.15%, and more preferably is 0.20%. A preferable upper limit of the Si content is 0.85%, and more preferably is 0.70%.

Mn: 0.02 to 1.00%

Manganese (Mn) deoxidizes the steel. Mn also enhances the hardenability of the steel material. If the Mn content is too low, the aforementioned effects cannot be obtained, even when the contents of other elements are within the range of the present embodiment. On the other hand, if the Mn content is too high, Mn segregates at grain boundaries together with impurities such as P and S. As a result, the SSC resistance and/or low-temperature toughness of the steel material decreases. In addition, if the Mn content is too high, the numerical proportion of fine precipitates in the steel material will decrease and in some cases the SSC resistance and/or low-temperature toughness of the steel material will decrease, even when the contents of other elements are within the range of the present embodiment. Therefore, the Mn content is within a range of 0.02 to 1.00%. A preferable lower limit of the Mn content is 0.03%, and more preferably is 0.05%. A preferable upper limit of the Mn content is 0.90%, more preferably is 0.80%, further preferably is 0.70%, and further preferably is 0.60%.

P: 0.025% or Less

Phosphorous (P) is an impurity. That is, the lower limit of the P content is more than 0%. If the P content is too high, P segregates at the grain boundaries and decreases the low-temperature toughness and the SSC resistance of the steel material, even when the contents of other elements are within the range of the present embodiment. Therefore, the P content is 0.025% or less. A preferable upper limit of the P content is 0.020%, and more preferably is 0.015%. Preferably, the P content is as low as possible. However, if the P content is excessively reduced, the production cost increases significantly. Therefore, when taking industrial production into consideration, a preferable lower limit of the P content is 0.0001%, more preferably is 0.0003%, further preferably is 0.001%, and further preferably is 0.003%.

S: 0.0100% or Less

Sulfur (5) is an impurity. That is, the lower limit of the S content is more than 0%. If the S content is too high, S segregates at the grain boundaries and decreases the low-temperature toughness and SSC resistance of the steel material, even when the contents of other elements are within the range of the present embodiment. Therefore, the S content is 0.0100% or less. A preferable upper limit of the S content is 0.0050%, and more preferably is 0.0030%. Preferably, the S content is as low as possible. However, if the S content is excessively reduced, the production cost increases significantly. Therefore, when taking industrial production into consideration, a preferable lower limit of the S content is 0.0001%, more preferably is 0.0002%, and further preferably is 0.0003%.

Al: 0.005 to 0.100%

Aluminum (Al) deoxidizes the steel material, lithe Al content is too low, the aforementioned effect cannot not be sufficiently obtained, even when the contents of other elements are within the range of the present embodiment. On the other hand, if the Al content is too high, coarse oxide-based inclusions are formed and the SSC resistance of the steel material decreases, even when the contents of other elements are within the range of the present embodiment. Therefore, the Al content is within a range of 0.005 to 0.100%. A preferable lower limit of the Al content is 0.015%, and more preferably is 0.020%. A preferable upper limit of the Al content is 0.080%, and more preferably is 0.060%. In the present description, the "Al" content means "acid-soluble Al", that is, the content of "sol. Al".

Cr: 0.40 to 1.50%

Chromium (Cr) enhances the hardenability of the steel material. Cr also concentrates in cementite in the steel material and thereby suppresses Ostwald growth of the cementite. Therefore, the numerical proportion of precipitates having an equivalent circular diameter within a range of 20 to 300 nm among precipitates having an equivalent circular diameter of 20 nm or more in the steel material increases. As a result, the low-temperature toughness and SSC resistance of the steel material increases, Cr also increases the temper softening resistance of the steel material and enables high-temperature tempering. As a result, the low-temperature toughness and the SSC resistance of the steel material increase. If the Cr content is too low, the aforementioned effects cannot not be sufficiently obtained, even when the contents of other elements are within the range of the present embodiment. On the other hand, if the Cr content is too high, the low-temperature toughness and the SSC resistance of the steel material will decrease, even when the contents of other elements are within the range of the present embodiment. Therefore, the Cr content is within a range of 0.40 to 1.50%. A preferable lower limit of the Cr content is 0.50%, and more preferably is 0.51%. A preferable upper limit of the Cr content is 1.30%, and more preferably is 1.25%.

Mo: 0.30 to 1.50%

Molybdenum (Mo) enhances the hardenability of the steel material. Mo also increases the temper softening resistance of the steel material and enables high-temperature tempering. As a result, the low-temperature toughness and SSC resistance of the steel material increase. If the Mo content is too low, the aforementioned effects cannot not be sufficiently obtained, even when the contents of other elements are within the range of the present embodiment. On the other hand, if the Mo content is too high, the aforementioned effects are saturated. Therefore, the Mo content is within a range of 0.30 to 1.50%. A preferable tower limit of the Mo content is 0.40%, and more preferably is 0.50%. A preferable upper limit of the Mo content is 1.40%, more preferably is 1.30%, and further preferably is 1.25%.

Ti: 0.002 to 0.050%

Titanium (Ti) combines with N to form nitrides, and thereby refines grains of the steel material by the pinning effect. As a result, the strength of the steel material increases. If the Ti content is too low, the aforementioned effect cannot not be sufficiently obtained, even when the contents of other elements are within the range of the present embodiment. On the other hand, if the Ti content is too high, Ti nitrides coarsen and the SSC resistance of the steel material decreases, even when the contents of other elements are within the range of the present embodiment. Therefore, the Ti content is within a range of 0.002 to 0.050%. A preferable lower limit of the Ti content is 0.003%, and more preferably is 0.005%. A preferable upper limit of the Ti content is 0.030%, and more preferably is 0.020%.

B: 0.0001 to 0.0050%

Boron (B) dissolves in the steel, enhances the hardenability of the steel material and increases the steel material strength if the B content is too low, the aforementioned effect cannot not be sufficiently obtained, even when the contents of other elements are within the range of the present embodiment. On the other hand, if the B content is too high, coarse nitrides form and the SSC resistance of the steel material decreases, even when the contents of other elements are within the range of the present embodiment. Therefore, the B content is within a range of 0.0001 to 0.0050%. A preferable lower limit of the B content is 0.0003%, and more preferably is 0.0007%. A preferable upper limit of the B content is 0.0030%, more preferably is 0.0025%, further preferably is 0.0020%, and further preferably is 0.0015%.

N: 0.0100% or Less

Nitrogen (N) is unavoidably contained. That is, the lower limit of the N content is more than 0%. N combines with Ti to form nitrides, and thereby refines grains of the steel material by the pinning effect. As a result, the strength of the steel material increases. However, if the N content is too high, coarse nitrides are formed and the low-temperature toughness and SSC resistance of the steel material decreases, even when the contents of other elements are within the range of the present embodiment. Therefore, the N content is 0.0100% or less. A preferable upper limit of the N content is 0.0050%, and more preferably is 0.0045%. A preferable lower limit of the N content for more effectively obtaining the aforementioned effect is 0.0005%, more preferably is 0.0010%, further preferably is 0.0015%, and further preferably is 0.0020%.

O: 0.0100% or Less

Oxygen (O) is an impurity, That is, the lower limit of the O content is more than 0%. If the O content is too high, O forms coarse oxides, and causes the low-temperature toughness and SSC resistance of the steel material to decrease, even when the contents of other elements are within the range of the present embodiment, Therefore, the O content is 0.0100% or less. A preferable upper limit of the O content is 0.0050%, more preferably is 0.0030%, and further preferably is 0.0020%. Preferably, the O content is as low as possible. However, if the O content is excessively reduced, the production cost increases significantly. Therefore, when taking industrial production into consideration, a preferable lower limit of the O content is 0.0001%, more preferably is 0.0002%, and further preferably is 0.0003%.

The balance of the chemical composition of the steel material according to the present embodiment is Fe and impurities. Here, the term "impurities" refers to elements which, during industrial production of the steel material, are mixed in from ore or scrap that is used as a raw material of the steel material, or from the production environment or the like, and which are allowed within a range that does not adversely affect the steel material according to the present embodiment.

[Optional Elements]

The chemical composition of the steel material described above may further contain one or more types of elements selected from the group consisting of V and Nb in lieu of a part of Fe. Each of these elements is an optional element, and increases, the low-temperature toughness and the SSC resistance of the steel material.

V: 0 to 0.60%

Vanadium (V) is an optional element, and need not be contained. That is, the V content may be 0%. If contained, V combines with C or N to form carbides, nitrides or carbo-nitrides (hereinafter, referred to as "carbo-nitrides and the like"). Carbo-nitrides and the like refine the grains of the steel material by the pinning effect, and increase the low-temperature toughness and SSC resistance of the steel material. V also forms fine carbides during tempering to increase the temper softening resistance of the steel material and to increase the strength of the steel material. If even a small amount of V is contained, the aforementioned effects can be obtained to a certain extent. However, if the V content is too high, the low-temperature toughness of the steel material decreases, even when the contents of other elements are within the range of the present embodiment. Therefore, the V content is within the range of 0 to 0.60%. A preferable lower limit of the V content is more than 0%, more preferably is 0.01%, further preferably is 0.02%, further preferably is 0.04%, and further preferably is 0.06%. A preferable upper limit of the V content is 0.40%, more preferably is 0.30%, and further preferably is 0.20%.

Nb: 0 to 0.030%

Niobium (Nb) is an optional element, and need not be contained. That is, the Nb content may be 0%. If contained, Nb forms carbo-nitrides and the like, Carbo-nitrides and the like refine the grains of the steel material by the pinning effect, and increase the low-temperature toughness and SSC resistance of the steel material. Nb also forms fine carbides during tempering and thereby increases the temper softening resistance of the steel material and enhances the strength of the steel material. If even a small amount of Nb is contained, the aforementioned effects can be obtained to a certain extent. However, if the Nb content is too high, carbo-nitrides and the like are excessively formed and the low-temperature toughness and the SSC resistance of the steel material decrease, even when the contents of other elements are within the range of the present embodiment. Therefore, the Nb content is within the range of 0 to 0.030%, A preferable lower limit of the Nb content is more than 0%, more preferably is 0.002%, further preferably is 0.003%, and further preferably is 0.007%. A preferable upper limit of the Nb content is 0.025%, and more preferably is 0.020%.

The chemical composition of the steel material described above may further contain one or more types of elements selected from the group consisting of Ca, Mg, Zr and rare earth metal in lieu of a part of Fe. Each of these elements is an optional element, and render S in the steel material harmless by forming sulfides. As a result, these elements increase the low-temperature toughness and SSC resistance of the steel material.

Ca: 0 to 0.0100%

Calcium (Ca) is an optional element, and need not be contained. That is, the Ca content may be 0%. If contained, Ca renders S in the steel material harmless by forming sulfides, and increases the low-temperature toughness and the SSC resistance of the steel material. If even a small amount of Ca is contained, the aforementioned effect can be obtained to a certain extent. However, if the Ca content is too high, oxides in the steel material coarsen and the low-temperature toughness and the SSC resistance of the steel material decrease, even when the contents of other elements are within the range of the present embodiment. Therefore, the Ca content is within the range of 0 to 0.0100%. A preferable lower limit of the Ca content is more than 0%, more preferably is 0.0001%, further preferably is 0.0003%, further preferably is 0.0006%, and further preferably is 0.0010%. A preferable upper limit of the Ca content is 0.0040%, more preferably is 0.0025%, and further preferably is 0.0020%.

Mg: 0 to 0.0100%

Magnesium (Mg) is an optional element, and need not be contained, That is, the Mg content may be 0%. If contained, Mg renders S in the steel material harmless by forming sulfides, and increases the low-temperature toughness and the SSC resistance of the steel material. If even a small amount of Mg is contained, the aforementioned effect can be obtained to a certain extent. However, if the Mg content is too high, oxides in the steel material coarsen and decrease the low-temperature toughness and the SSC resistance of the steel material, even when the contents of other elements are within the range of the present embodiment Therefore, the Mg content is within the range of 0 to 0.0100%. A preferable lower limit of the Mg content is more than 0%, more preferably is 0.0001%, further preferably is 0.0003%, further preferably is 0.0006%, and further preferably is 0.0010%. A preferable upper limit of the Mg content is 0.0040%, more preferably is 0.0025%, and further preferably is 0.0020%.

Zr: 0 to 0.0100%

Zirconium (Zr) is an optional element, and need not be contained. That is, the Zr content may be 0%. If contained, Zr renders S in the steel material harmless by forming sulfides, and increases the low-temperature toughness and the SSC resistance of the steel material. If even a small amount of Zr is contained, the aforementioned effect can be obtained to a certain extent. However, if the Zr content is too high, oxides in the steel material coarsen and the low-temperature toughness and the SSC resistance of the steel material decrease, even when the contents of other elements are within the range of the present embodiment. Therefore, the Zr content is within the range of 0 to 0.0100%. A preferable lower limit of the Zr content is more than 0%, more preferably is 0.0001%, further preferably is 0.0003%, further preferably is 0.0006%, and further preferably is 0.0010%. A preferable upper limit of the Zr content is 0.0040%, more preferably is 0.0025%, and further preferably is 0.0020%.

Rare Earth Metal (REM): 0 to 0.0100%

Rare earth metal (REM) is an optional element, and need not be contained. That is, the REM content may be 0%. If contained, the REM renders S in the steel material harmless by forming sulfides, and increases the SSC resistance of the steel material, REM also combines with P in the steel material and suppresses segregation of P at the crystal grain boundaries. Therefore, a decrease in the low-temperature toughness and the SSC resistance of the steel material that is attributable to segregation of P is suppressed. If even a small amount of REM is contained, the aforementioned effects can be obtained to a certain extent. However, if the REM content is too high, oxides in the steel material coarsen and the low-temperature toughness and SSC resistance of the steel material decrease, even when the contents of other elements are within the range of the present embodiment. Therefore, the REM content is within the range of 0 to 0.0100%. A preferable lower limit of the REM content is more than 0%, more preferably is 0.0001%, further preferably is 0.0003%, and further preferably is 0.0006%. A preferable upper limit of the REM content is 0.0040%, and more preferably is 0.0025%.

Note that, in the present description the term "REM" refers to one or more types of elements selected from a group consisting of scandium (Sc) which is the element with atomic number 21, yttrium (Y) which is the element with atomic number 39, and the elements from lanthanum (La) with atomic number 57 to lutetium (Lu) with atomic number 71 that are lanthanoids. Further, in the present description the term "REM content" refers to the total content of these elements.

The chemical composition of the steel material described above may further contain one or more types of elements selected from the group consisting of Co and W in lieu of a part of Fe. Each of these elements is an optional element that forms a protective corrosion coating in a sour environment and suppresses the penetration of hydrogen into the steel material. As a result, each of these elements increases the SSC resistance of the steel material.

Co: 0 to 0.50%

Cobalt (Co) is an optional element, and need not be contained. That is, the Co content may be 0%. If contained, in a sour environment Co forms a protective corrosion coating and suppresses the penetration of hydrogen into the steel material, By this means, Co enhances the SSC resistance of the steel material. If even a small amount of Co is contained, the aforementioned effect can be obtained to a certain extent. However, if the Co content is too high, the hardenability of the steel material will decrease, and the strength of the steel material will decrease, even when the contents of other elements are within the range of the present embodiment. Therefore, the Co content is within the range of 0 to 0.50%. A preferable lower limit of the Co content is more than 0%, more preferably is 0.02%, further preferably is 0.03%, and further preferably is 0.05%. A preferable upper limit of the Co content is 0.45%, and more preferably is 0.40%.

W: 0 to 0.50%

Tungsten (W) is an optional element, and need not be contained. That is, the W content may be 0%. If contained, W forms a protective corrosion coating in a sour environment and suppresses hydrogen penetration into the steel material. Thereby, the SSC resistance of the steel material increases. If even a small amount of W is contained, the aforementioned effect can be obtained to a certain extent. However, if the W content is too high, coarse carbides form in the steel material, and the low-temperature toughness and the SSC resistance of the steel material decrease, even when the contents of other elements are within the range of the present embodiment. Therefore, the W content is within the range of 0 to 0.50%. A preferable lower limit of the W content is more than 0%, more preferably is 0.02%, further preferably is 0.03%, and further preferably is 0.05%. A preferable upper limit of the W content is 0.45%, and more preferably is 0.40%.

The chemical composition of the steel material described above may further contain one or more types of elements selected from the group consisting of Ni and Cu in lieu of a part of Fe. Each of these elements is an optional element, and increases the hardenability of the steel material.

Ni: 0 to 0.10%

Nickel (Nit is an optional element, and need not be contained. That is, the Ni content may be 0%. If contained, Ni enhances the hardenability of the steel material and increases the strength of the steel material. In addition, Ni dissolves in the steel and enhances the low-temperature toughness of the steel material. If even a small amount of Ni is contained, the aforementioned effects can be obtained to a certain extent. However, if the Ni content is too high, the Ni will promote local corrosion, and the SSC resistance of the Steel material will decrease, even when the contents of other elements are within the range of the present embodiment. Therefore, the Ni content is within the range of 0 to 0.10%. A preferable lower limit of the Ni content is more than 0%, more preferably is 0.01%, and further preferably is 0.02%. A preferable upper limit of the Ni content is 0.09%, more preferably is 0.08%, and further preferably is 0.06%.

Cu: 0 to 0.50%

Copper (Cu) is, an optional element, and need not be contained. That is, the Cu content way be 0%. If contained, Cu enhances the hardenability of the steel material and increases the strength of the steel material. If even a small amount of Cu is contained, the aforementioned effects can be obtained to a certain extent. However, if the Cu content is too high, the hardenability of the steel material will be too high, and the SSC resistance of the steel material will decrease, even when the contents of other elements are within the range of the present embodiment. Therefore, the Cu content is within the range of 0 to 0.50%. A preferable lower limit of the Cu content is more than 0%, more preferably is 0.01%, further preferably is 0.02%, and further preferably is 0.05%. A preferable upper limit of the Cu content is 0.35%, and more preferably is 0.25%.

[Regarding Formula (1)]

The steel material according to the present embodiment also satisfies Formula (1) below.

$$(0.157\times C-0.0006\times Cr-0.0098\times Mo-0.0482\times V+0.0006)/\theta_{Cr}\leq 0.300 \quad (1)$$

where, a content in mass % of a corresponding element is substituted for each symbol of an element in Formula (1). If the corresponding, element is not contained, "0" is substituted for the symbol of an element. Further, the Cr concentration in mass fraction in precipitates having an equivalent circular diameter of 20 nm or more is substituted for $\theta_{Cr}$ in Formula (1).

Fn1(=$(0.157\times C-0.0006\times Cr-0.0098\times Mo-0.0482\times V+0.0006)/\theta_{Cr}$) is an index relating to the numerical proportion of precipitates having an equivalent circular diameter within a range of 20 to 300 nm among precipitates having an equivalent circular diameter of 20 nm or more (numerical proportion of fine precipitates $NP_F$). As long as the other conditions of the present embodiment are satisfied and Fat is not more than 0.300, the numerical proportion of fine precipitates $NP_F$ in the steel material can be increased to 0.85 or more.

Cr concentrates in cementite and can suppress Ostwald growth of the cementite. Specifically, by concentrating in cementite, Cr can suppress dissolution of fine cementite particles in the matrix in a tempering process in a production process that is described later. As a result, Cr can suppress coarsening of cementite by Ostwald growth.

In a steel material having the aforementioned chemical composition, almost all of the precipitates having an equivalent circular diameter of 20 nm or more are cementite. On the other hand, in a steel material having the aforementioned chemical composition, there is a possibility that MC-type carbides and $M_2C$-type carbides are included in precipitates having an equivalent circular diameter of less than 20 nm. Therefore, in Formula (1) of the steel material according to the present embodiment, the Cr concentration $\theta_{Cr}$ in precipitates having an equivalent circular diameter of 20 nm or more is defined. As a result, in Formula (1) of the steel material according to the present embodiment, the Cr concentration in cementite can substantially be defined.

As described above, the Cr concentration $\theta_{Cr}$ contained in precipitates having an equivalent circular diameter of 20 nm or more that is the denominator of Fn1 is an index that indicates the degree of difficulty of Ostwald growth of cementite. If $\theta_{Cr}$ that is the denominator of Fn1 is increased, there is a possibility that coarsening, of cementite will be suppressed and the numerical proportion of fine precipitates $NP_F$ will be increased. Further, as described above, the numerator of Fn1 is an index of the total precipitation amount of cementite. In a steel material having the aforementioned chemical composition, the larger the total precipitation amount of cementite is, the easier it is for coarse cementite to be formed. That is, if the numerator of Fn1 is reduced, there is a possibility that the numerical proportion of fine precipitates $NP_F$ will be increased.

In short, Fn1 is an index relating to the numerical proportion of fine precipitates $NP_F$. As long as the other conditions of the present embodiment are satisfied and Fn1 is not more than 0.300, the numerical proportion of fine precipitates $NP_F$ in the steel material can be increased to 0.85 or more. Therefore, m the steel material according to the present embodiment, Fn1 is not more than 0.300. A preferable upper limit of Fn1 is 0.295, more preferably is 0.290, further preferably is 0.285, further preferably is 0.280, more preferably is 0.260, and further preferably is (0.240, If Fn1 is not more than 0.240, in some cases the SSC resistance of the steel material increases further. The lower limit of Fn1 is not particularly limited. The lower limit of Fn1 is, for example, 0.

The Cr concentration $\theta_{Cr}$ contained in precipitates having an equivalent circular diameter of 20 nm or more can be determined by the following method. A micro test specimen for creating an extraction replica is prepared from the steel material according to the present embodiment. If the steel material is a steel plate, the micro test specimen is prepared from a center portion of the plate thickness. If the steel material is a steel pipe, the micro test specimen is prepared from a center portion of the wall thickness. The surface of the micro test specimen is mirror-polished, and thereafter the micro test specimen is immersed for 10 minutes in a 3% nital etching reagent to etch the surface. The etched surface is then covered with a carbon deposited film. The micro test specimen whose surface is covered with the deposited film is immersed for 20 minutes in a 5% nital etching reagent. The deposited film is peeled off from the immersed micro test specimen. The deposited film that was peeled off from the micro test specimen is cleaned with ethanol, and thereafter is scooped up with a sheet mesh and dried.

The deposited film (replica film) is observed using a transmission electron microscope (TEM). Specifically, arbitrary locations among the deposited film are specified, and observation of the specified locations is conducted using an observation magnification of ×10000 and an acceleration voltage of 200 kV. Note that, the number of locations that are specified is not particularly limited as long as the number of Locations is at least three. Further, each visual field is, for example, 8 μm×8 μm. Precipitates having an equivalent circular diameter of 20 nm or more are identified in each visual field to specify a total of 20 precipitate particles for the entire visual fields, and are defined as "specific precipitates". Note that the precipitates can be identified based on contrast. The equivalent circular diameter of the respective precipitates can be determined by image analysis of an observation image in TEM observation.

The specific precipitates (precipitates having an equivalent circular diameter of 20 nm or more) are subjected to point analysis by energy dispersive X-ray spectrometry (EDS). By means of the point analysis by EDS, the Cr concentration is determined in units of mass percent when taking the total of the alloying elements excluding carbon in each precipitate as 100%. The Cr concentration is determined for 20 specific precipitate particles, and the arithmetic average value of the obtained values is defined as the Cr concentration $\theta_{Cr}$ (unit: mass fraction) in the specific precipitates.

[Regarding Formula (2)]

The steel material according to the present embodiment satisfies the following Formula (2).

$$(1+263\times C-Cr-16\times Mo-80\times V)/(98-358\times C+159\times Cr+15\times Mo+96\times V)\leq 0.355 \quad (2)$$

Where, a content in mass % of a corresponding element is substituted each symbol of an element in Formula (2). If a corresponding element is not contained, "0" is substituted for the symbol of the relevant element.

Fn2(=(1+263×C−Cr−16×Mo−80×V)/(98−358×CH−159×Cr−15×Mo+96×V)) is an index that indicates the degree to which it is difficult for Cr to concentrate in precipitates. If Fn2 is not more than 0.355, Cr concentrates sufficiently in precipitates and it is easy to cause Ostwald growth of cementite to be suppressed. Therefore, in the steel material according to the present embodiment, Fn2 is not more than 0.355.

A preferable upper limit of Fn2 is 0.350, more preferably is 0.340, further preferably is 0.330, further preferably is 0.320, more preferably is 0.310, and further preferably is 0300. As long as Fn2 is not more than 0.300, Fn1 can be made 0.240 or less, and in some cases the SSC resistance of the steel material increases further. The lower limit of Fn2 is not particularly limited. The lower limit of Fn2 is, for example, 0.

[Microstructure]

The microstructure of the steel material according to the present embodiment is principally composed of tempered martensite and tempered bainite. More specifically, the total of the volume ratios of tempered martensite and tempered bainite in the microstructure is 90% or more. The balance of the microstructure is, for example, ferrite or pearlite. If the microstructure of the steel material having the aforementioned chemical composition contains tempered martensite and tempered bainite in an amount equivalent to a total volume ratio of 90% or more, on the condition that the other requirements according to the present embodiment are satisfied, the yield strength of the steel material will be 862 MPa or more (125 ksi or more). That is, in the present embodiment, if the yield strength of the steel material is 862 MPa or more, it can be determined that the total of the volume ratios of tempered martensite and tempered bainite in the microstructure is 90% or more.

Note that, the following method can be adopted in the case of determining the volume ratio of tempered martensite and tempered bainite by observation. In a case where the steel material is a steel plate, a test specimen having an observation surface with dimensions of 10 mm in the rolling direction and 10 mm in the thickness direction is prepared from a center portion of the thickness. In a case where the steel material is a steel pipe, a test specimen having an observation surface with dimensions of 10 mm in the pipe axis direction and 8 mm in the wall thickness (pipe radius) direction is prepared from a center portion of the wall thickness.

After polishing the observation surface of the test specimen to obtain a mirror surface, the test specimen is immersed for about 10 seconds in a vital etching reagent, to reveal the microstructure by etching. The etched observation surface is observed by performing observation with respect to 10 visual fields by means of a secondary electron image, obtained using a scanning electron microscope (SEM). The visual field area is, for example, 400 $\mu m^2$ (magnification of ×5000). In each visual field, tempered martensite and tempered bainite are identified based on the contrast. The area fractions of the identified tempered martensite and tempered bainite are determined. The method of the measurement of the area fractions will not be particularly limited and a well-known method can be used. For example, the area fractions of tempered martensite and tempered bainite can be determined by performing the image processing. In the present embodiment, the arithmetic average value of the area fractions of tempered martensite and tempered bainite determined in all of the visual fields is defined as the volume ratio of tempered martensite and tempered bainite.

[Numerical Proportion of Fine Precipitates]

In the steel material according to the present embodiment, the numerical proportion of precipitates having an equivalent circular diameter within a range of 20 to 300 nm among precipitates having an equivalent circular diameter of 20 nm or more in the steel material is 0.85 or more. As described above, the numerical proportion of precipitates having an equivalent circular diameter within a range of 20 to 300 nm among precipitates having an equivalent circular diameter of 20 nm or more in the steel material is also referred to as "numerical proportion of fine precipitates $NP_F$". Note that as described above, in the present description, the term "equivalent circular diameter" means the diameter of a circle in a case where the area of a precipitate observed on a visual field surface during micro-structure observation is converted into a circle having the same, area.

As described above, heretofore no particular attention has been paid to the distribution of the size of precipitates in a steel material having the aforementioned chemical composition. However, referring to FIG. 1 and FIG. 2, as a result of detailed studies conducted by the present inventors, it was clarified that, in a steel material having the aforementioned chemical composition, in a case where cementite coarsens due to Ostwald growth, the number density of precipitates having an equivalent circular diameter within the range of 20 to 300 nm noticeably decreases, and the number density of precipitates having an equivalent circular diameter of more than 300 nm increases a little.

Note that, FIG. 1 and FIG. 2 are histograms illustrating the relation between the equivalent circular diameter and number density of precipitates included in the steel material, with respect to one example of a steel material having the aforementioned chemical composition and a yield strength of 125 ksi grade (862 to less than 965 MPa). That is, referring to FIG. 1 and FIG. 2, in a steel material having the aforementioned chemical composition and a yield strength of 125 ksi grade, if the number density of coarse precipitates increases, it is clarified that although a significant variation is not confirmed with regard to the number density of coarse precipitates having an equivalent circular diameter of more than 300 nm, a noticeable decrease in the number density of precipitates having an equivalent circular diameter of 300 nm or less. Further, the tendency for that is also confirmed in the steel material having a yield strength of 140 ksi grade (965 to 1069 MPa).

Figure 5:
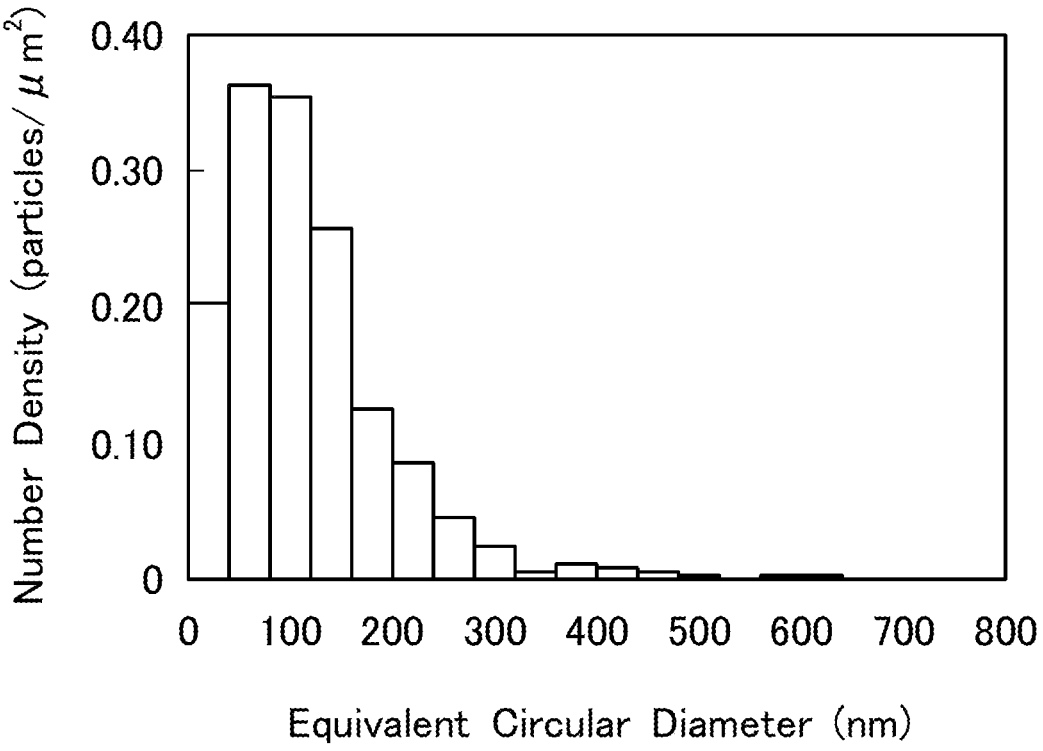
FIG. 5 is a schematic diagram illustrating the relation between the equivalent circular diameter and number density of precipitates with respect to another example of a steel material having the chemical composition of the present embodiment different from FIG. 1 and FIG. 2.
Figure 6:
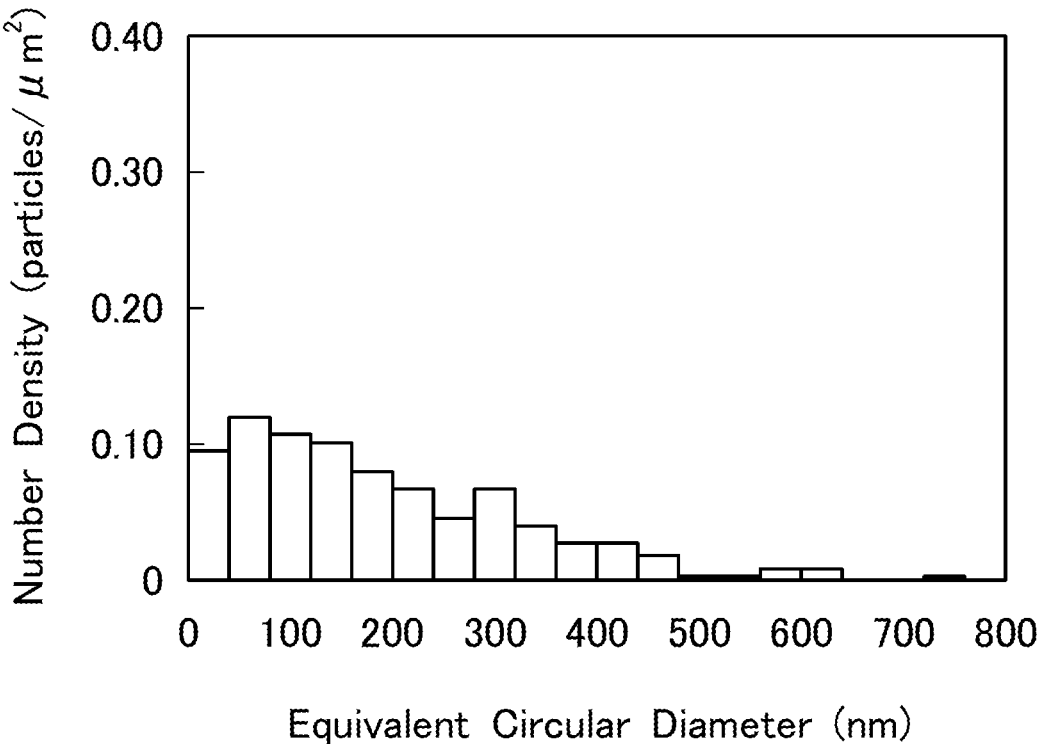
FIG. 6 is a schematic diagram illustrating the relation between the equivalent circular diameter and number density of precipitates with respect to another example of a steel material having the chemical composition of the present embodiment different from FIG. 1, FIG. 2 and FIG. 5.

Specifically, FIG. 5 is a histogram illustrating the relation between the equivalent circular diameter and number density of precipitates with respect to another example of a steel material having the chemical composition of the present embodiment different from FIG. 1 and FIG. 2. FIG. 6 is a histogram illustrating the relation between the equivalent circular diameter and number density of precipitates with respect to another example of a steel material having the chemical composition of the present embodiment different from FIG. 1, FIG. 2 and FIG. 5. More specifically, FIG. 5 and FIG. 6 are histograms that was created with respect to the steel materials having the aforementioned chemical composition and a yield strength of 140 ksi grade (965 to 1069 MPa) using the equivalent circular diameter and number density of precipitates included in the steel material.

Referring to FIG. 1, FIG. 2, FIG. 5 and FIG. 6, in the steel material having the aforementioned chemical composition, not only in a case where the steel material having a yield strength of 125 ksi grade, but also in a case where the steel material having, a yield strength of 140 ksi grade, although a significant variation is not confirmed with regard to the number density of coarse precipitates having an equivalent circular diameter of more than 300 nm, a noticeable decrease in the number density of precipitates having an equivalent circular diameter of 300 nm or less.

Further, referring to FIG. 3 and FIG. 4, in a steel material having the aforementioned chemical composition, if the numerical proportion of fine, precipitates is 0.85 or more, the steel material has a yield strength of 862 MPa or more, exhibits excellent low-temperature toughness and also exhibits excellent SSC resistance. Therefore, in the steel material according to the present embodiment, the numerical proportion of precipitates having an equivalent circular diameter within a range of 20 to 300 nm among precipitates having an equivalent circular diameter of 20 nm or more (numerical proportion of fine precipitates $NP_F$) is made 0.85 or more. A preferable lower limit of the numerical proportion of fine precipitates $NP_F$ is 0.87, more preferably is 0.89, further preferably is 0.92, and further preferably is 0.94.

Specifically, if the steel material has the aforementioned chemical composition, and satisfies the conditions that Fn2 is not more than 0.300 and Fn1 is not more than 0.240, in some cases the numerical proportion of fine precipitates $NP_F$ increases further. More specifically, when the yield strength is within a range of 862 to less than 965 MPa, the numerical proportion of fine precipitates $NP_F$ is 0.92 or more, and the SSC resistance of the steel material increases further. Also, when the yield strength is 965 MPa or more, the numerical proportion of fine precipitates $NP_F$ is 0.94 or more, and the SSC resistance of the steel material increases further. On the other band, the upper limit of the numerical proportion of fine precipitates $NP_F$ is not particularly limited. The numerical proportion of line precipitates $NP_F$ may be 1.00.

The numerical proportion of fine precipitates $NP_F$ in the steel material according to the present embodiment can be determined by the following method. A test specimen is prepared from the steel material according to the present embodiment. The test specimen is prepared in the same manner as the test specimen used in the aforementioned micro-structure observation. Specifically, in a case where the steel material is a steel plate, a test specimen having an observation surface with dimensions of 10 mm in the rolling direction and 10 mm in the thickness direction is prepared from a center portion of the thickness. In a case where the steel material is a steel pipe, a test specimen having an observation surface with dimensions of 10 mm in the pipe axis direction and 8 mm in the wall thickness (pipe radius) direction is prepared from a center portion of the wall thickness.

After polishing the observation surface of the test specimen to obtain a mirror surface, the test specimen is immersed for 60 seconds in a picral etching reagent (2.0 mass % picric acid ethanol solution), to ties a the microstructure by etching. The etched observation surface is subjected to three-dimensional roughness measurement using an SEM to thereby obtain a three-dimensional roughness profile of each visual field. If the number of observation visual fields is three or more visual fields and the total of the area of the observation visual fields is 300 $\mu m^2$ or more, the reproducibility of the numerical proportion of fine precipitates $NP_F$ is enhanced. Therefore, in the present embodiment the number of observation visual fields is set to not less than three visual fields. In addition, the visual field area is, for example, 108 $\mu m^2$ (magnification of ×10000) that is 12 μm×9 μm.

Although the number of pixels (picture elements) into which the visual field area is divided is not particularly limited, it is preferable to make a single pixel not more than 0.020 μm×0.020 μm in order to obtain stable measurement accuracy. If a single pixel is 0.020 μm×0.020 μm, that is, 20 nm×20 nm, it is possible to detect precipitates of 20 nm or more by means of three-dimensional roughness measurement. Note that, in a case where a single pixel is set as 0.020 μm×0.020 μm in the aforementioned visual field area, the visual field area is divided into 270000 pixels in the form of 600×450 pixels.

A method for performing three-dimensional roughness measurement is not particularly limited, and a well-known method can be used. For example, four secondary electron detectors may be arranged in an SEM, and a three-dimensional roughness profile may be obtained by combining the detection results of the four secondary electron detectors. In each visual field, the focal depth direction in the SEM observation is defined as "height direction". In each visual field, a plane perpendicular to the height direction is defined as "observation plane", In addition, with respect to the aforementioned height direction, the direction from the observation plane toward the electron beam source is defined as the positive direction (direction in which the height increases). An area fraction $Z_h$ (%) that the steel material occupies in the visual field area of the observation plane at a position h (μm) in the height direction is determined from a three-dimensional roughness profile obtained by the aforementioned method. At this time, the resolution in the height direction is, for example, 1 nm.

In this case, a lowest height $h_0$ and a highest height $h_1$ are identified in each visual field. The height "$h_0$" means the maximum value among heights h at which $Z_h$=100.0% and for which a corresponding area fraction $Z_{h0}$=100.0%. The height "$h_1$" means the minimum value among heights h at which $Z_h$=0.0% and for which a corresponding area fraction $Z_{h1}$=0.0%.

A plot in which the position h (μm) in the height direction is taken as the abscissa and the area fraction $Z_h$ (%) that the steel material occupies is taken as the ordinate is created with respect to the respective visual fields. At this time, the range of the positions h in the height direction is set as $h_0$ to $h_1$.

Next, an area fraction S (%) of precipitates in each visual field is determined. In the present embodiment, the volume ratio (%) of precipitates in the steel material is determined and is taken as the area fraction S (%) of precipitates in each visual field. In addition, in the present embodiment, as described above, precipitates having an equivalent circular diameter of 20 ram or more are detected. Therefore, in the present embodiment, the area fraction S (%) of precipitates in each visual field means the volume ratio (%) of precipitates having an equivalent circular diameter of 20 nm or more.

Further, as described above, most of the precipitates, having an equivalent circular diameter of 20 nm or more are cementite. In addition, among the volume ratio of the cementite, the volume ratio of cementite having an equivalent circular diameter that is less than 20 nm is small enough to be negligible. Therefore, the area fraction S (%) of precipitates in each visual field can be approximated as a volume ratio $V_\theta$ (%) of cementite in the steel material according to the present embodiment. Thus, in the present embodiment, the volume ratio $V_\theta$ (%) of cementite is determined as the area fraction S (%) of precipitates in each visual field.

A method for determining the volume ratio $V_\theta$ of cementite is not particularly limited, and a well-known method can be used. For example, $V_\theta$ may be determined by thermodynamic calculation, in this case, by performing a thermodynamic calculation using the chemical composition and a tempering temperature in a production process that is described later, the proportion that cementite occupies in the volume of the system overall (entire structure including the matrix, cementite, and other precipitates and inclusions) can be determined. Note that, in the case of performing a thermodynamic calculation, the thermodynamic calculation may be performed using well-known thermodynamic calculation software. Thus, it is sufficiently possible for a person skilled in the art to determine the volume ratio $V_\theta$ (%) of cementite by thermodynamic calculation.

The volume ratio $V_\theta$ of cementite may also be determined by capturing extraction residue. In this case, the volume ratio $V_\theta$ of cementite can be determined by the following method, A cylindrical test specimen is prepared from the steel material according to the present embodiment. In a case where the steel material is a steel plate, the cylindrical test specimen is prepared from a center portion of the thickness. In a case where the steel material is a steel pipe, the cylindrical test specimen is prepared from a center portion of the wall thickness. The size of the cylindrical test specimen is, for example, a diameter of 6 mm and a length of 50 mm. The surface of the prepared cylindrical test specimen is polished to remove about 50 μm by preliminary electropolishing to obtain a newly formed surface. The test specimen in which the newly formed surface was obtained is subjected to electrolysis using an electrolyte solution (10% acetylacetone+1% tetra-ammonium+methanol). The electrolyte solution after electrolysis is passed through a 0.2 μm filter to capture residue.

The obtained residue is subjected to acid decomposition, and the concentrations of alloying elements excluding carbon in cementite are determined in units of mass percent by ICP (inductively coupled plasma) emission spectrometry. The volume ratio $V_\theta$ (%) of cementite is determined based on the obtained concentrations of alloying elements excluding carbon in cementite and the following Formula (A).

$$V_\theta = (\text{sum of molar fractions of respective alloying elements in cementite}) \times (1/3) \times (V_{m\theta}/V_m) \quad (A)$$

The "molar fractions of respective alloying elements in cementite" in Formula (A) can be determined by the following method. The amount of each alloying element dissolved in cementite can be acquired by analysis of extraction residue. The molar fractions of the respective alloying elements in the cementite can be determined by dividing the acquired amount of each alloying element by the total amount that was electrolyzed.

Further, $V_{m\theta}$ in Formula (A) represents the molar volume ($m^3$/mol) of cementite. In addition, $V_m$ in Formula (A) represents the molar volume ($m^3$/mol) of the system overall (entire structure including the matrix, cementite, and other precipitates and inclusions). Note that, $V_{m\theta}$ and $V_m$ can each be obtained by means of well-known thermodynamic calculation software.

As described above, in the present embodiment a method for determining the Volume ratio $V_\theta$ of cementite is not particularly limited, and the aforementioned method that utilizes thermodynamic calculation may be used or the aforementioned method that captures extraction residue may be used. Further, in the steel material according to the present embodiment having the aforementioned chemical composition, there is almost no difference between the area fraction S (that is, the volume ratio $V_\theta$ of cementite) of precipitates obtained by the method that utilizes thermodynamic calculation and the area fraction S of precipitates obtained by the method that captures extraction residue. Therefore, whichever method is used, the area fraction S (%) of precipitates in each visual field area can be determined.

The equivalent circular diameter, the numerical proportion and the number density of the each precipitate are determined based on the area fraction S (%) of the precipitate that was determined, a plot of the height h (μm) and area fraction $Z_h$ (%) determined by the aforementioned method, and a three-dimensional roughness profile obtained by the aforementioned method. Specifically, the equivalent circular diameter and the number density of the respective precipitates can be determined as follows. From the aforementioned plot, a height at which the area fraction $Z_h$(%) is closest to the area fraction S (%) is identified, and is defined as $h_t$ (μm). Based on the obtained height $h_t$ and the three-dimensional roughness profile, the distribution of the steel material in a visual field at the height $h_t$ is acquired as two-dimensional information.

A region that the steel material occupies and vacant space are included in the two-dimensional information of the distribution of the steel material in a visual field. At this time, the region that the steel material occupies is, more specifically, a region that precipitates occupy. Therefore, by analyzing the acquired two-dimensional information, the respective equivalent circular diameters of the precipitates in the visual field can be determined. In this way, the equivalent circular diameters of all of the precipitates in the visual field region are determined, Based on the equivalent circular diameters of the respective precipitates that are obtained, the number of precipitates having an equivalent circular diameter of 20 nm or more and the number of precipitates having an equivalent circular diameter within a range of 20 to 300 nm are counted.

The aforementioned method is performed for each visual field to thereby count the number of precipitates having an equivalent circular diameter of 20 nm or more and the number of precipitates having an equivalent circular diameter within a range of 20 to 300 nm in each visual field. The numerical proportion of precipitates having an equivalent circular diameter within a range of 20 to 300 nm among the precipitates having an equivalent circular diameter of 20 nm or more can be determined based on the sum of the numbers of precipitates having an equivalent circular diameter of 20 nm or more and the sum of the numbers of precipitates having an equivalent circular diameter within a range of 20 to 300 nm in all of the visual fields.

[Regarding Formula (3)]

Preferably, the steel material according to the present embodiment also may satisfy Formula (3) below.

$$NP_F/ND_C \geq 4.25 \quad (3)$$

where, the numerical proportion of precipitates having an equivalent circular diameter within a range of 20 to 300 nm among precipitates having an equivalent circular diameter of 20 nm or more (numerical proportion of fine precipitates) is substituted for "$NT_F$" in Formula (3), Further, the number density of precipitates having an equivalent circular diameter of 300 nm or more (number density of coarse precipitates) (particles/$\mu m^2$) is substituted for "$ND_C$" Formula (3).

It is defined that $Fn3 = NP_F/ND_C$. Fn3 is an index that indicates the total number of cementite. If Fn3 is not less than 4.25, the total number of cementite decreases, the low-temperature toughness of the steel material increases further. Therefore, in the steel material according to the present embodiment, the numerical proportion of fine precipitates $NP_F$ is 0.85 or more, and further, Fn3 is preferably not less than 4.25. A more preferable lower limit of Fn3 is 4.30, and further preferably is 4.50, Note that, the upper limit of Fn3 is not particularly limited, for example, 330.00.

In the steel material according to the present embodiment, the number density of precipitates having an equivalent circular diameter of 300 nm or more (number density of coarse precipitates $ND_C$) (particles/$\mu m^2$) can be obtained at the same time as numerical proportion of fine precipitates $NP_F$. Specifically, the number density of coarse precipitates $ND_C$ can be determined by the following method. The number of precipitates having an equivalent circular diameter of 300 nm or more is counted using the obtained respective equivalent circular diameters of the precipitates in the visual field when determining the numerical proportion of fine precipitates $NP_F$. The number density of precipitates having an equivalent circular diameter of 300 nm or more (number density of coarse precipitates $ND_C$) (particles/$\mu m^2$) can be determined based on the sum of the numbers of precipitates having an equivalent circular diameter of 300 nm or more and the gross area of the all visual fields.

[Shape of Steel Material]

The shape of the steel material according to the present embodiment is not particularly limited. The steel material is, for example, a steel pipe or a steel plate. In a case where the steel material is an oil-well steel pipe, the steel material is preferably a seamless steel pipe. In a case where the steel material according to the present embodiment is a seamless steel pipe, the wall thickness is not particularly limited and, for example, is within the range of 9 to 60 mm. The steel material, according to the present embodiment is particularly suited for use as a heavy-wall seamless steel pipe. More specifically, even if the steel material according to the present embodiment is a heavy-wall seamless steel pipe with a thickness of 15 mm or more or, furthermore, 20 mm or more, the steel material exhibits excellent strength, excellent, low-temperature toughness and excellent SSC resistance.

[Yield Strength of Steel Material]

The yield strength of the steel material according to the present embodiment is 862 MPa or more (125 ksi or more). As used in the present description, the term "yield strength" means 0.2% offset proof stress obtained in a tensile test in conformity with ASTM E8/E8M (2013). Note that, an upper limit of the yield strength of the steel material according to the present embodiment is not particularly limited. Meanwhile, at least when the yield strength is within a range of 862 to 1069 MPa, it has been proved by examples described later that the steel material according to the present embodiment has excellent low-temperature toughness and excellent SSC resistance. Accordingly, the yield strength of the steel material according to the present embodiment includes at least 862 to 1069 MPa (125 to 155 ksi). In other words, the yield strength of the steel material according to the present embodiment includes at least 862 to less than 965 MPa (125 ksi grade) and 965 to 1069 MPa (140 ksi grade).

The yield strength of the steel material according to the present embodiment can be determined by the following method. Specifically, a tensile test is performed in conformity with ASTM E8/E8M (2013). A round bar test specimen is prepared from the steel material according to the present embodiment. If the steel material is a steel plate, the round bar test specimen is prepared from the center portion of the thickness. If the steel material is a steel pipe, the round bar test specimen is taken from the center portion of the wall thickness. Regarding, the size of the round bar test specimen, for example, the round bar test specimen has a parallel portion diameter of 4 mm and a parallel portion length of 35 nm. Note that the axial direction of the round bar test specimen is parallel to the rolling direction of the steel material. A tensile test is performed in the atmosphere at normal temperature (25° C.) using the round bar test specimen, and obtained 0.2% offset proof stress is defined as the yield strength (MPa).

[Low-Temperature Toughness of Steel Material]

The low-temperature toughness of the steel material according to the present embodiment can be evaluated by a Charpy impact test in conformity with JIS Z 2242 (2005). Specifically, the ow-temperature toughness of the steel material according to the present embodiment is defined as follows.

[Low-Temperature Toughness when Yield Strength is 862 to Less than 965 MPa]

A test specimen is prepared from the steel material according to the present embodiment. If the steel material is a steel plate, the test specimen is prepared from the center portion of the thickness. If the steel material is a steel pipe, the test specimen is prepared from the center portion of the wall thickness. A V-notch test specimen having a width of 10 mm and a length of 55 mm is used as the test specimen. Note that, the longitudinal direction of the test specimen is parallel to a direction that is orthogonal to the rolling direction of the steel material and the rolling reduction direction of the steel material. The notched surface of the test specimen is perpendicular to the rolling direction of the steel material.

A Charpy impact test in conformity with JIS Z 2242 (2005) is performed on the test specimen that is cooled to −75° C. to thereby deter rime the absorbed energy vE(−75° C.)(J) at −75° C. In the steel material according to the present embodiment, in a case where the yield strength is 862 to less than 965 MPa, if the absorbed energy vE(−75° C.) at −75° C. is 105 J or more, it is evaluated that the steel material has excellent low-temperature toughness. A more preferable lower limit of the absorbed energy, vE(−75° C.) of the steel material according to the present embodiment is 110 J, and further preferably is 115 J. Although an upper limit of the absorbed energy vE(−75° C.) of the steel material according to the present embodiment is not particularly limited, the upper limit is, for example, 300 J.

[Low-Temperature Toughness when Yield Strength is 965 MPa or More]

A test specimen is prepared from the steel material according to the present embodiment. If the steel material is a steel plate, the test specimen is prepared from the center portion of the thickness. If the steel material is a steel pipe, the test specimen is prepared from the center portion of the wall thickness, A VT-notch test specimen having a width of 10 mm and a length of 55 mm is used as the test specimen. Note that, the longitudinal direction of the test specimen is parallel to a direction that is orthogonal to the rolling direction of the steel material and the rolling reduction direction of the steel material. The notched surface of the test specimen is perpendicular to the rolling direction of the steel material.

A Charpy impact test in conformity with JIS Z 2242 (2005) is performed on the test specimen that is cooled to α60° C. to thereby determine the absorbed energy vE(−60° C.)(J) at −60° C. in the steel material according to the present embodiment, in a case where the yield strength is 965 MPa or more, if the absorbed energy vE(−60° C.) at −60° C. is 70 J or more, it is evaluated that the steel material has excellent low-temperature toughness. A more preferable lower limit of the absorbed energy vE(−60° C.) of the steel material according to the present embodiment is 71 J, and further preferably is 72 J. Although an upper limit of the absorbed energy vE(−60° C.) of the steel material according to the present embodiment is not particularly limited, the upper limit is, for example, 300 J.

[SSC Resistance of Steel Material]

The SSC resistance of the steel material according to the present embodiment can be evaluated by a method in accordance with "Method A" specified in NACE TM0177-2005. Specifically, SSC resistance of the steel material according to the present embodiment is defined as follows.

[SSC Resistance when Yield Strength is 862 to Less than 965 MPa]

A round bar test specimen is prepared from the steel material according to the present embodiment, if the steel material is a steel plate, the round bar test specimen is prepared from the center portion of the thickness. If the steel material is a steel pipe, the round bar test specimen is prepared from the center portion of the wall thickness. Regarding the size of the round bar test specimen, for example, the round bar test specimen has a diameter of 6:35 mm and a parallel portion length of 25.4 mm. Note that the axial direction of the round bar test specimen is parallel to the rolling direction of the steel material.

A mixed aqueous solution containing 5.0 mass % of sodium chloride and 0.5 mass % of acetic acid (NACE solution A) is employed as the test solution. The temperature of the test solution is set to 24° C. A stress equivalent to 90% of the actual yield stress (90% AYS) is applied to the round bar test specimen. The test solution at 24° C. is poured into a test vessel so that the round bar test specimen to which the stress has been applied is immersed therein, and this is adopted as a test bath. After degassing the test bath, $H_2S$ gas at 1 atm pressure is blown into the test bath and is caused to saturate in the test bath. The test bath is held at 24° C. for 720 hours (30 days).

In a case where the yield strength is 862 to less than 965 MPa, when the method in accordance with Method A that is described above is performed on the steel material according to the present embodiment, if cracking is not confirmed after 720 hours (30 days) elapse, it is evaluated that the steel material has excellent SSC resistance. Note that, in the present description, the phrase "cracking is not confirmed" means that cracking is not confirmed in the test specimen in a case where the test specimen after the test was observed by the naked eye and by means of a projector with a magnification of ×10.

In the steel material according to the present embodiment, if the yield strength is 862 to less than 965 MPa and the numerical proportion of fine precipitates is 0.92 or more, the steel material according to the present embodiment has even more excellent SSC resistance. Here, in a case where the yield strength is 862 to less than 965 MPa, the phrase "even more excellent SSC resistance" means, specifically, that cracking is not confirmed after 720 hours (30 days) elapse in a case where a test is performed that is identical to the aforementioned method in accordance with "Method A" specified in NACE TM0177-2005, other than that the stress applied to the round bar test specimen is made 95% of the actual yield stress (95% AYS).

[SSC Resistance when Yield Strength is 965 MPa or More]

A round bar test specimen is prepared from the steel material according to the present embodiment. If the steel material is a steel plate, the round bar test specimen is prepared from the center portion of the thickness. If the steel material is a steel pipe, the round bar test specimen is prepared from the center portion of the wall thickness. Regarding the size of the round bar test specimen, for example, the round bar test specimen has a diameter of 6.35 mm and a parallel portion length of 25.4 mm, Note that the axial direction of the round bar test specimen is parallel to the rolling direction of the steel material.

A mixed aqueous solution containing 5.0 mass % of sodium chloride and 0.4 mass % of sodium acetate that is adjusted to pH 3.5 using acetic acid (NACE solution B) is employed as the test solution. The temperature of the test solution is set to 24° C. A stress equivalent to 90% of the actual yield stress (90% AYS) is applied to the round bar test specimen. The test solution at 24° C. is poured into a test vessel so that the round bar test specimen to which the stress has been applied is immersed therein, and this is adopted as a test bath. After degassing the test bath, a mixed gas of $H_2S$ gas at 0.1 atm pressure and $CO_2$ gas at 0.9 atm pressure is blown into the test bath and is caused to saturate in the test bath. The test bath is held at 24° C. for 720 hours (30 days).

In a case where the yield strength is 965 MPa or more, when the method in accordance with Method A that is, described above is performed on the steel material according to the present embodiment, if cracking is not confirmed after 720 hours (30 days) elapse, it is evaluated that the steel material has excellent SSC resistance. Note that, in the present description, the phrase "cracking is not confirmed" means that cracking is not confirmed in the test specimen in a case where the test specimen after the test was observed by the naked eye and by means of a projector with a magnification of ×10.

In the steel material according to the present embodiment, if the yield strength is 965 MPa or more and the numerical, proportion of fine precipitates is 0.94 or more, the steel material according to the present embodiment has even more excellent SSC resistance. Here, in a case where the yield strength is 965 M Pa or more, the phrase "even more excellent SSC resistance" means, specifically, that cracking is not continued after 720 hours (30 days) elapse in a case where a test is performed that is identical to the aforementioned method in accordance with "Method A" specified in NACE TM0177-2005, other than that the blown gas is made a mixed gas of $H_2S$ gas at 0.2 atm pressure and $CO_2$ gas at 0.8 atm pressure.

[Production Method]

A method for producing the steel material according to the present embodiment will now be described. The production method described hereunder is a method for producing a seamless steel pipe as one example of the steel material according to the present embodiment. The method for producing a seamless steel pipe includes a process of preparing a hollow shell (preparation process), and a process of subjecting the hollow shell to quenching and tempering to form a seamless steel pipe (quenching process and tempering process). Note that, a production method according to the present embodiment is not limited to the production method described hereunder. Each process is described in detail hereunder.

[Preparation Process]

In the preparation process, an intermediate steel material having the aforementioned chemical composition is prepared. As long as the intermediate steel material has the aforementioned chemical composition, the method for producing the intermediate steel material is not particularly limited. As used here, the term "intermediate steel material" refers to a plate-shaped steel material in a case where the end product is a steel plate, and refers to a hollow shell in a case where the end product is a steel pipe.

The preparation process may include a process in which a starting material is prepared (starting material preparation process), and a process in which the starting material is subjected to hot working to produce an intermediate steel material (hot working process). Hereunder, a case in which the preparation process includes the starting material preparation process and the hot working process is described in detail.

[Starting Material Preparation Process]

In the starting material preparation process, a starting material is produced using molten steel having the aforementioned chemical composition. The method for producing the starting material is not particularly limited, and a well-known method can be used. Specifically, a cast piece (a slab, bloom or billet) ma be produced by a continuous casting process using the molten steel. An ingot may also be produced by an ingot-making process using the molten steel. As necessary, the slab, bloom or ingot may be subjected to blooming to produce a billet. The starting material (a slab, bloom or billet) is produced by the above described process.

[Hot Working Process]

In the hot working process, the starting material that was prepared is subjected to hot working to produce an intermediate steel material in a case where the steel material is a seamless steel pipe, the intermediate steel material corresponds to a hollow shell. First, the billet is heated in a heating furnace. Although the heating temperature is not particularly limited, for example, the heating temperature is within a range of 1100 to 1300° C. The billet that is extracted from the heating furnace is subjected to hot working to produce a hollow shell (seamless steel pipe). The method of performing the hot working is not particularly limited, and a well-known method can be used.

For example, the Mannesmann process is performed as the hot working to produce the hollow shell. In this case, a round billet is piercing-rolled using a piercing machine. When performing piercing-rolling, although the piercing ratio is not particularly limited, the piercing ratio is, for example, within a range of 1.0 to 4.0. The round billet that underwent piercing-rolling is further hot-rolled to form a hollow shell using a mandrel mill, a reducer, a sizing mill or the like. The cumulative reduction of area in the hot working process is, for example, 20 to 70%.

A hollow shell may also be produced from the billet by performing another hot working method. For example, in the case of a heavy-wall steel material of a short length such as a coupling, a hollow shell may be produced by forging by the Ehrhardt process or the like. A hollow shell is produced by the above process. Although not particularly limited, the wall thickness of the hollow shell is, for example, 9 to 60 mm.

The hollow shell produced by hot working may be air-cooled (as-rolled). The hollow shell produced by hot working may be subjected to direct quenching after hot working without being cooled to normal temperature, or may be subjected to quenching after undergoing supplementary heating (reheating) after hot working.

In a case of performing direct quenching after hot working, or performing quenching after supplementary heating, cooling may be stopped midway through the quenching process or slow cooling may be performed. In this case, the occurrence of quench cracking in the hollow shell can be suppressed. In addition, in the case of performing direct quenching after hot working, or performing quenching after supplementary heating, a stress relief annealing (SR) may be performed at a time that is after quenching and before the heat treatment of the next process. In this case, residual stress of the hollow shell is eliminated.

As described above, an intermediate steel material is prepared in the preparation process. The intermediate steel material may be produced by the aforementioned preferable process, or may be an intermediate steel material that was produced by a third party, or an intermediate steel material that was produced in another factory other than the factory in which a quenching process and a tempering process that are described later are performed, or at a different works. The quenching process is described in detail hereunder.

[Quenching Process]

In the quenching process, the intermediate steel material (hollow shell) that was prepared is subjected to quenching. In the present description, the term "quenching" means rapidly cooling the intermediate steel material that is at a temperature not less than the $A_3$ point. A preferable quenching temperature is 800 to 1000° C. If the quenching temperature is too high, in some cases crystal grains of prior-γ grains become coarse and the SSC resistance of the steel material decreases. Therefore, a quenching temperature in the range of 800 to 1000° C. is preferable.

In the present description, in a case where direct quenching is performed after hot working, the term "quenching temperature" corresponds to the surface temperature of the intermediate steel material that is measured by a thermometer placed on the exit side of the apparatus that performs the final hot working. Further, in a case where quenching is performed after supplementary heating or reheating after hot working, the term "quenching temperature" corresponds to the temperature of the furnace that performs the supplementary heating or reheating.

The quenching method, for example, continuously cools the intermediate steel material. (hollow shell) from the quenching starting temperature, and continuously decreases the surface temperature of the hollow shell. The method of performing the continuous cooling treatment is not particularly limited, and a well-known method can be used. The method of performing the continuous cooling treatment is, for example, a method that cools the hollow shell by immersing the hollow shell in a water bath, or a method that cools the hollow shell in an accelerated manner by shower water cooling or mist cooling.

If the cooling rate during quenching is too slow, the microstructure daces not become one that is principally composed of martensite and bainite, and the mechanical properties defined in the present embodiment (a yield strength of 125 ksi or more) cannot be obtained. In this case, in addition, excellent low-temperature toughness and excellent SSC resistance are not obtained.

Therefore, as described above, in the method for producing the steel material according to the present embodiment, the intermediate steel material is rapidly cooled during quenching. Specifically, in the quenching process, the average cooling rate when the surface temperature of the intermediate steel material (hollow shell) is within the range of 800 to 500° C. during quenching is defined as a cooling rate during quenching $CR_{800-500}$. More specifically, the cooling rate during quenching $CR_{800-500}$ is determined based on a temperature that is measured at a region that is most slowly cooled within a cross-section of the intermediate steel material that is being quenched (for example, in the case of forcedly cooling both surfaces, the cooling rate is measured at the center portion of the thickness of the intermediate steel material).

A preferable cooling rate during quenching $CR_{800-500}$ is 300° C./min or higher. A more preferable lower limit of the cooling rate during quenching $CR_{800-500}$ is 450° C./min, and further preferably is 600° C./min. Although an upper limit of the cooling rate during quenching $CR_{800-500}$ is not particularly defined, the upper limit is for example, 60000° C./min.

Preferably, quenching is performed after performing heating, of the hollow shell in the austenite zone a plurality of times. In this case, the SSC resistance of the steel material increases because austenite grains are refined prior to quenching. Heating in the austenite zone may be repeated a plurality of times by performing quenching a plurality of times, or heating in the austenite zone may be repeated a plurality of times by performing normalizing, and quenching. Further, quenching and tempering that is described later may be performed in combination a plurality of times. That is, quenching and tempering may be performed a plurality of times. In this case, the SSC resistance of the steel material increases further. The tempering process is described in detail hereunder.

[Tempering Process]

The tempering process is carried out by performing tempering after performing the aforementioned quenching. In the present description, the term "tempering" means reheating the intermediate steel material after quenching to a temperature that is less than the $A_{c1}$ point and holding the intermediate steel material at that temperature. Here, the tempering temperature corresponds to the temperature of the furnace when the intermediate steel material after quenching is heated and held at the relevant temperature. The tempering time means the period of time from the temperature of the intermediate steel material reaching a predetermined tempering temperature till the extracting from the heat treatment furnace.

As described above, in the steel material according to the present embodiment, most of the precipitates having an equivalent circular diameter of 20 nm or more are cementite, in addition, the cementite is liable to coarsen due to Ostwald growth during holding for tempering. In particular, in the case of producing a steel material that is to be used for oil wells, for the purpose of increasing the low-temperature toughness and the SSC resistance, the tempering temperature is set within the range of 600 to 730° C. In tempering at such a high temperature, there is a tendency for cementite to easily coarsen due to Ostwald growth.

Therefore, in the tempering process according to the present embodiment, tempering at a high temperature is performed for a short time period to form a large number of cementite nuclei in advance. Thereafter, tempering is performed at a temperature which is a little lower (hereunder, also referred to as "intermediate-temperature tempering") than the temper in the high-temperature tempering to cause the large number of cementite nuclei formed as described above to grow. As a result, a large number of fine cementite particles can be formed in the steel material according to the present embodiment. That is, in the tempering process according to the present embodiment, tempering is performed in two stages, namely, high-temperature tempering and intermediate-temperature tempering, in that order. According to this method, in the steel material, the numerical proportion of precipitates having an equivalent circular diameter within a range of 20 to 300 nm among the precipitates having an equivalent circular diameter of 20 nm or more (numerical proportion of fine precipitates $NP_F$) can be raised to 0.85 or more. And further, according to this method, Fn3 ($=NP_F/ND_C$) is raised to 4.25 or more. Hereunder, the high-temperature tempering process and intermediate-temperature tempering process are described in detail.

[High-Temperature Tempering Process]

In the high-temperature tempering process, the intermediate steel material (hollow shell) that was subjected to quenching is heated from room temperature to the tempering temperature, and thereafter is held at the tempering temperature for the tempering time. As a result, a large number of cementite nuclei are formed in the microstructure of the intermediate steel material after the high-temperature tempering process.

In the high-temperature tempering process, if the heating rate from room temperature to the tempering temperature is too slow, in some cases carbides may precipitate from grain boundaries during heating. In comparison to carbides that precipitated from inside grains, the carbides that precipitated from grain boundaries are more liable to become coarse. Therefore, in the high-temperature tempering process according to the present embodiment, the heating rate from room temperature to the tempering temperature is made a fast rate.

Specifically, the heating rate in the range of 100 to 650° C. is defined as a heating rate during tempering $HR_{100\text{-}650}$ (° C./min). More specifically, the heating rate during tempering $HR_{100\text{-}650}$ is determined based on a temperature that is measured at a region that is most slowly heated within a cross-section of the intermediate steel material that is being heated (for example, in the case of heating from both surfaces of the steel material, the heating rate is measured at the center portion of the thickness of the intermediate steel material).

In the high-temperature tempering process according to the present embodiment, a preferable heating rate during tempering $HR_{100\text{-}650}$ is 5° C./min or higher. A more preferable lower limit of the heating rate during tempering $HR_{100\text{-}650}$ is 8° C./min, and further preferably is 10° C./min. The upper limit of the heating rate during tempering $HR_{100\text{-}650}$ is not particularly limited, and for example is 60000° C./min.

If the tempering temperature in the high-temperature tempering process is too low, the cementite nuclei will not sufficiently precipitate during holding for tempering, and the cementite will be coarsened by the intermediate-temperature tempering process that is described later. As a result, in the steel material after the intermediate-temperature tempering process, the numerical proportion of fine precipitates $NP_F$ will be less than 0.85, and the low-temperature toughness and SSC resistance of the steel material will decrease.

On the other hand, if the tempering temperature in the high-temperature tempering process is too high, the tempering temperature may become higher than the $A_{C1}$ point. In such a case, austenite will be mixed in the microstructure of the intermediate steel material. As a result, the microstructure of the steel material after the intermediate-temperature tempering process that is described later will not be principally composed of tempered martensite and tempered bainite, and mechanical properties defined in the present embodiment cannot be obtained. Therefore, in the high-temperature tempering process according to the present embodiment, a preferable tempering temperature is within the range of 695 to 720° C. A more preferable lower limit of the tempering temperature in the high-temperature tempering process is 700° C. A more preferable upper limit of the tempering temperature in the high-temperature tempering process is 715° C.

If the tempering time is too short, the cementite nuclei will not sufficiently precipitate during holding for tempering, and the cementite will be coarsened by the intermediate-temperature tempering process that is described later. As a result, in the steel material after the intermediate-temperature tempering process, the numerical proportion of fine precipitates $NP_F$ will be less than 0.85, and the low-temperature toughness and SSC resistance of the steel material will decrease.

On the other hand, if the tempering time in the high-temperature tempering process is too long, in some cases the cementite may coarsen during holding for tempering. As a result, in the steel material after the intermediate-temperature tempering process, the numerical proportion of fine precipitates $NP_F$ will be less than 0.85, and the low-temperature toughness and SSC resistance of the steel material will decrease. In addition, if the tempering time is too long, in some cases the yield strength will decrease.

Therefore, in the high-temperature tempering process according to the present embodiment, a preferable tempering time is within the range of 2 to less than 20 minutes. A more preferable upper limit of the tempering time in the high-temperature tempering process is 15 minutes. A more preferable lower limit of the tempering time in the high-temperature tempering process is 3 minutes, and further preferably is 5 minutes. Hereunder, the intermediate-temperature tempering process is described in detail.

[Intermediate-Temperature Tempering Process]

In the intermediate-temperature tempering process, the intermediate steel material (hollow shell) that was subjected to the high-tempera race tempering process is held for a tempering time at a tempering temperature in a temperature region that is a little lower than the temperature region in the high-temperature tempering process. In the intermediate-temperature tempering process, the yield strength of the steel material is adjusted to 862 MPa or more (125 ksi or more).

If the tempering temperature in the intermediate-temperature tempering process is too low, in some cases the yield strength of the steel material after tempering will be too high, in such a case, the strength will be too high, and the low-temperature toughness and SSC resistance of the steel material may decrease. On the other hand, if the tempering temperature in the intermediate-temperature tempering process is too high, in some cases the yield strength of the steel material after tempering may become lower. As a result, the yield strength will be less than 862 MPa, and a yield strength of 125 ksi or more will not be obtained.

Therefore, in the intermediate-temperature tempering process according to the present embodiment, a preferable tempering temperature is within the range of 600 to 690° C. A more preferable upper limit of the tempering temperature in the intermediate-temperature tempering process is less than 690° C., and further preferably is 685° C. A more preferable lower limit of the tempering, temperature in the intermediate-temperature tempering process is 620° C. and further preferably is 640° C.

If the tempering time in the intermediate-temperature tempering process is too short, in some cases the yield strength of the steel material after tempering will be too high. As a result, the strength will be too high, and the low-temperature toughness and SSC resistance of the steel material may decrease. On the other hand, if the tempering time is too long, the aforementioned effects are saturated.

Accordingly, in the present embodiment, a preferable tempering time in the intermediate-temperature tempering process is within the range of 10 to 180 minutes. A more preferable upper limit of the tempering time is 120 minutes, and further preferably is 90 minutes. A more preferable lower limit of the tempering time is 15 minutes, and further preferably is 20 minutes. Note that, in a case where the steel material is a steel pipe, in comparison to other shapes, temperature variations with respect to the steel pipe are liable to occur during holding for tempering. Therefore, in a case where the steel material is a steel pipe, the tempering time is preferably set within a range of 15 to 180 minutes.

As described above, in the intermediate-temperature tempering process, the tempering temperature and tempering time are adjusted to obtain a steel material having a yield strength of 125 ksi or more, Note that, it is sufficiently possible for a person skilled in the art to obtain a steel material having a yield strength of 125 ksi or more (862 MPa or more) by subjecting an intermediate steel material (hollow shell) having the chemical composition of the present embodiment to intermediate-temperature tempering in which the aforementioned tempering temperature and the aforementioned tempering time are appropriately adjusted.

Note that, the aforementioned high-temperature tempering process and intermediate-temperature tempering process may be performed as consecutive heat treatments. That is, the intermediate steel material that was subjected to the high-temperature tempering process may then be subjected to the intermediate-temperature tempering process without being cooled to room temperature. At such time, the high-temperature tempering process and the intermediate-temperature tempering process may be performed within the same heat treatment furnace.

In the case of performing the high-temperature tempering process and the intermediate-temperature tempering process consecutively within the same heat treatment furnace, a temperature gradient is formed within the heat treatment furnace and the temperature of the intermediate steel material is controlled. In this case, if the time period from when the high-temperature tempering process ends until the intermediate-temperature tempering process starts is too long, the holding time at the high temperature will be too long and the yield strength of the steel material after tempering may decrease. In addition, in such a case, in some cases the numerical proportion of fine precipitates $NP_F$ will not be increased. Therefore, in the case of forming a temperature gradient inside the heat treatment furnace and controlling the temperature of the intermediate steel material, the time period from the end of the high-temperature tempering process until the temperature of the intermediate steel material is adjusted to the tempering temperature of the intermediate-temperature tempering process is preferably made not more than 10 minutes, and more preferably is made not more than 5 minutes.

Furthermore, in the case of performing the high-temperature tempering process and the intermediate-temperature tempering process within the same heat treatment furnace, the intermediate steel material may be extracted from the heat treatment furnace after the end of the high-temperature tempering process, and thereafter the intermediate steel material may be inserted again into the same heat treatment furnace. In this case, after the end of the high-temperature tempering process, the intermediate steel material is inserted into the heat treatment furnace after the temperature in the heat treatment furnace is decreased to the tempering temperature for the intermediate-temperature tempering process.

In a case of performing the high-temperature tempering process and the intermediate-temperature tempering process as consecutive heat treatments, the tempering processes may be performed in different heat treatment furnace. In the case of performing the high-temperature tempering process and the intermediate-temperature tempering process in different heat treatment furnaces, the intermediate steel material that was extracted from the heat treatment furnace used for the high-temperature tempering process may be allowed to cool in the atmosphere until being inserted into the heat treatment furnace that is used for the intermediate-temperature tempering process. In this case, the time period from extracting the intermediate steel material from the heat treatment furnace used for the high-temperature tempering process to inserting the intermediate steel material into the heat treatment furnace used for the intermediate-temperature tempering process is preferably made not more than 10 minutes, and more preferably is made not more than 5 minutes.

On the other hand, the aforementioned high-temperature tempering process and intermediate-temperature tempering process can also be performed as non-consecutive heat treatments. That is, the intermediate-temperature tempering process may be performed after the intermediate steel material that was subjected to the high-temperature tempering process is cooled to room temperature. Thus, regardless of whether the high-temperature tempering process and the intermediate-temperature tempering process are performed as consecutive heat treatments or are performed as non-consecutive heat treatments, the effects obtained by the high-temperature tempering process and the intermediate-temperature tempering process are not impaired, and the steel material according to the present embodiment can be produced.

The steel material according to the present embodiment can be produced by, the production method that is described above. A method for producing a seamless steel pipe has been described as one example of the aforementioned production method. However, the steel material according to the present embodiment may be a steel plate or another shape. A method for producing a steel plate or a steel material of another shape also includes, for example, a preparation process, a quenching process and a tempering process, similarly to the production method described above. However, the aforementioned production method is one example, and the steel material according to the present embodiment may also be produced by another production method. Hereunder, the present disclosure is described more specifically by way of examples.

EXAMPLE 1

In Example 1, the steel material having, the yield strength of the steel material is of 125 ksi grade (862 to less than 965 MPa) was investigated. Specifically, molten steels of a weight of 180 kg having the chemical compositions shown in Table 1 were produced. In addition, Fn2 that was determined based on the obtained chemical composition and Formula (2) is shown in Table 1. Note that, "-" in Table 1 means that content of each element is at the level of an impurity.

TABLE 1

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | Ti | B | N | O |
| 1-1 | 0.26 | 0.22 | 0.38 | 0.011 | 0.0006 | 0.039 | 0.78 | 1.18 | 0.013 | 0.0012 | 0.0023 | 0.0007 |
| 1-2 | 0.31 | 0.27 | 0.26 | 0.009 | 0.0008 | 0.029 | 1.13 | 1.17 | 0.009 | 0.0011 | 0.0028 | 0.0013 |
| 1-3 | 0.31 | 0.25 | 0.44 | 0.010 | 0.0010 | 0.029 | 1.02 | 0.93 | 0.015 | 0.0011 | 0.0037 | 0.0016 |
| 1-4 | 0.26 | 0.32 | 0.21 | 0.007 | 0.0006 | 0.041 | 0.76 | 0.88 | 0.014 | 0.0012 | 0.0023 | 0.0015 |
| 1-5 | 0.27 | 0.34 | 0.47 | 0.007 | 0.0007 | 0.053 | 0.90 | 0.59 | 0.015 | 0.0014 | 0.0046 | 0.0014 |
| 1-6 | 0.26 | 0.32 | 0.09 | 0.012 | 0.0009 | 0.048 | 0.90 | 0.63 | 0.009 | 0.0013 | 0.0033 | 0.0019 |
| 1-7 | 0.30 | 0.28 | 0.19 | 0.010 | 0.0009 | 0.030 | 1.05 | 0.92 | 0.014 | 0.0015 | 0.0047 | 0.0006 |
| 1-8 | 0.26 | 0.34 | 0.42 | 0.011 | 0.0006 | 0.027 | 0.72 | 0.89 | 0.015 | 0.0014 | 0.0043 | 0.0019 |
| 1-9 | 0.28 | 0.32 | 0.37 | 0.011 | 0.0006 | 0.028 | 1.00 | 1.13 | 0.013 | 0.0014 | 0.0041 | 0.0014 |
| 1-10 | 0.27 | 0.30 | 0.06 | 0.008 | 0.0009 | 0.046 | 0.72 | 0.90 | 0.014 | 0.0013 | 0.0043 | 0.0015 |
| 1-11 | 0.26 | 0.22 | 0.46 | 0.007 | 0.0010 | 0.029 | 0.54 | 1.18 | 0.015 | 0.0014 | 0.0025 | 0.0017 |
| 1-12 | 0.30 | 0.26 | 0.40 | 0.008 | 0.0006 | 0.053 | 0.93 | 1.07 | 0.011 | 0.0013 | 0.0032 | 0.0018 |
| 1-13 | 0.31 | 0.26 | 0.40 | 0.007 | 0.0010 | 0.049 | 0.91 | 1.04 | 0.010 | 0.0012 | 0.0024 | 0.0016 |
| 1-14 | 0.29 | 0.29 | 0.47 | 0.007 | 0.0006 | 0.037 | 1.10 | 0.55 | 0.014 | 0.0014 | 0.0028 | 0.0017 |
| 1-15 | 0.29 | 0.27 | 0.40 | 0.007 | 0.0008 | 0.043 | 1.12 | 0.57 | 0.015 | 0.0014 | 0.0038 | 0.0009 |
| 1-16 | 0.32 | 0.27 | 0.36 | 0.006 | 0.0008 | 0.040 | 1.14 | 0.91 | 0.013 | 0.0011 | 0.0047 | 0.0017 |
| 1-17 | 0.28 | 0.31 | 0.36 | 0.012 | 0.0008 | 0.045 | 1.05 | 0.58 | 0.013 | 0.0011 | 0.0040 | 0.0011 |
| 1-18 | 0.24 | 0.28 | 0.42 | 0.009 | 0.0007 | 0.036 | 0.66 | 0.56 | 0.009 | 0.0013 | 0.0038 | 0.0019 |
| 1-19 | 0.26 | 0.28 | 0.36 | 0.011 | 0.0010 | 0.025 | 0.55 | 0.49 | 0.011 | 0.0014 | 0.0047 | 0.0010 |
| 1-20 | 0.31 | 0.29 | 0.46 | 0.007 | 0.0009 | 0.053 | 0.13 | 1.12 | 0.014 | 0.0013 | 0.0033 | 0.0012 |
| 1-21 | 0.29 | 0.30 | 0.36 | 0.011 | 0.0010 | 0.043 | 1.07 | 0.11 | 0.009 | 0.0014 | 0.0027 | 0.0010 |
| 1-22 | 0.30 | 0.33 | 1.61 | 0.006 | 0.0007 | 0.038 | 1.07 | 0.66 | 0.010 | 0.0015 | 0.0036 | 0.0014 |
| 1-23 | 0.28 | 0.27 | 0.35 | 0.007 | 0.0009 | 0.052 | 1.12 | 0.62 | 0.009 | 0.0012 | 0.0344 | 0.0018 |
| 1-24 | 0.31 | 0.26 | 0.35 | 0.066 | 0.0008 | 0.027 | 1.14 | 0.83 | 0.012 | 0.0013 | 0.0048 | 0.0009 |

| Test | Chemical Composition (Unit is mass %; balance is Fe and impurities) | | | | | | | | | | |
|---|---|---|---|---|---|---|---|---|---|---|---|
| Number | V | Nb | Ca | Mg | Zr | Nd | Co | W | Ni | Cu | Fn2 |
| 1-1 | — | — | — | — | — | — | — | — | — | — | 0.339 |
| 1-2 | 0.08 | — | — | — | — | — | — | — | — | — | 0.293 |
| 1-3 | 0.15 | — | — | — | — | — | — | — | — | — | 0.308 |
| 1-4 | 0.12 | 0.010 | — | — | — | — | — | — | — | — | 0.299 |
| 1-5 | 0.12 | — | 0.0015 | — | — | — | — | — | — | — | 0.316 |
| 1-6 | 0.14 | — | — | 0.0011 | — | — | — | — | — | — | 0.276 |
| 1-7 | 0.12 | — | — | — | 0.0012 | — | — | — | — | — | 0.298 |
| 1-8 | 0.08 | — | — | — | — | 0.0014 | — | — | — | — | 0.342 |
| 1-9 | 0.13 | — | — | — | — | — | 0.21 | — | — | — | 0.243 |
| 1-10 | 0.11 | — | — | — | — | — | — | 0.22 | — | — | 0.344 |
| 1-11 | 0.14 | — | — | — | — | — | — | — | 0.04 | — | 0.318 |
| 1-12 | 0.13 | — | — | — | — | — | — | — | — | 0.15 | 0.308 |
| 1-13 | 0.10 | — | — | — | — | — | — | — | — | — | 0.363 |
| 1-14 | 0.10 | — | — | — | — | — | — | — | — | — | 0.318 |
| 1-15 | 0.09 | 0.014 | — | — | — | — | — | — | — | — | 0.316 |
| 1-16 | 0.07 | — | — | — | — | — | — | — | — | — | 0.345 |

TABLE 1-continued

| | | | | | | | | | | | |
|---|---|---|---|---|---|---|---|---|---|---|---|
| 1-17 | 0.09 | — | — | — | — | — | — | — | — | — | 0.314 |
| 1-18 | 0.08 | 0.015 | — | — | — | — | — | — | — | — | 0.361 |
| 1-19 | 0.09 | — | — | — | — | — | — | — | — | — | 0.496 |
| 1-20 | 0.09 | — | — | — | — | — | — | — | — | — | 1.729 |
| 1-21 | 0.11 | — | — | — | — | — | — | — | — | — | 0.372 |
| 1-22 | 0.14 | — | — | — | — | — | — | — | — | — | 0.310 |
| 1-23 | 0.12 | — | — | — | — | — | — | — | — | — | 0.275 |
| 1-24 | 0.09 | — | — | — | — | — | — | — | — | — | 0.322 |

Ingots were produced using the molten steels of Test Numbers 1-1 to 1-24. The produced ingots were hot roiled to produce steel plates having a thickness of 15 mm. The steel plates of Test Numbers 1-1 to 1-24 after hot rolling were allowed to cool to bring the steel plate temperature to normal temperature (25° C.). After being allowed to cool, the steel plates of Test Numbers 1-1 to 1-24 were held for 20 minutes at the quenching temperature (920° C.), the steel plates were immersed in a water bath to be quenched. At this time, the cooling rate during quenching ($CR_{800-500}$) was 600° C./min for each test number. Note that, a type K thermocouple of a sheath type was inserted into a center portion of the thickness of the steel plate in advance, and the quenching temperature and cooling rate during quenching $CR_{800-500}$ were measured using the type K thermocouple.

After quenching, the steel plates of Test Numbers 1-1 to 1-24 were subjected to a tempering process. For the steel plate of each test number excluding Test Numbers 1-14 to 1-16, a first tempering and a second tempering were performed. On the other hand, for the steel plates of Test Numbers 1-14 to 1-16, a tempering was performed only once. The tempering temperature and the tempering time performed for the steel plates of Test Numbers 1-1 to 1-24 for each of the first tempering and the second tempering are as shown in Table 2. Note that, "-" in the "Second Tempering" column in Table 2 means that the second tempering was not performed.

Here, the heating rate during tempering ($HR_{100-650}$) in the first tempering was 10° C./min for Test Numbers 1-1 to 1-24. Note that, a type K thermocouple of a sheath type was inserted into a center portion of the thickness of the steel plate in advance, and the tempering temperature and the heating rate during tempering $HR_{100-650}$ were measured using the type K thermocouple. Also, in the present example, the tempering temperature was the temperature of the heat treatment furnace where the tempering is performed. Further, in the present example, the tempering time was taken as the period of time from the temperature of the steel plate of each test number reaching a predetermined tempering temperature till the extracting from the heat treatment furnace.

For the steel plate of each test number excluding Test Numbers 1-14 to 1-16, the first tempering and the second tempering were performed using different heat treatment furnaces. Specifically, the steel plate of each test number excluding Test Numbers 1-14 to 1-16 was subjected to the first tempering, and thereafter was extracted from the heat treatment furnace. The extracted steel plate of each test number excluding Test lumbers 1-14 to 1-16 was allowed to cool in the atmosphere, and immediately after reaching the second tempering temperature the steel plate in question was inserted into a different heat treatment furnace whose temperature had been adjusted for use for the second tempering, and second tempering was performed. Note that, the time

TABLE 2

| | First Tempering | | Second Tempering | | | | | | | | SSC Resistance | |
|---|---|---|---|---|---|---|---|---|---|---|---|---|
| Test Number | Tempering Temperature (° C.) | Tempering Time (min) | Tempering Temperature (° C.) | Tempering Time (min) | YS (MPa) | $\theta_{Cr}$ (mass fraction) | Fn1 | $NP_F$ | Fn3 | vE (−75° C.) (J) | 90% AYS | 95% AYS |
| 1-1 | 705 | 10 | 670 | 80 | 941 | 0.1121 | 0.262 | 0.90 | 5.72 | 122 | E | NA |
| 1-2 | 705 | 5 | 690 | 50 | 904 | 0.1435 | 0.232 | 0.94 | 7.81 | 152 | E | E |
| 1-3 | 710 | 5 | 680 | 40 | 950 | 0.1323 | 0.244 | 0.91 | 6.41 | 132 | E | NA |
| 1-4 | 705 | 15 | 690 | 30 | 895 | 0.1127 | 0.236 | 0.93 | 7.17 | 143 | E | E |
| 1-5 | 715 | 5 | 690 | 50 | 890 | 0.1226 | 0.252 | 0.91 | 5.90 | 127 | E | NA |
| 1-6 | 705 | 5 | 690 | 50 | 891 | 0.1278 | 0.219 | 0.95 | 9.05 | 165 | E | E |
| 1-7 | 705 | 10 | 690 | 50 | 909 | 0.1369 | 0.236 | 0.93 | 7.35 | 146 | E | E |
| 1-8 | 705 | 5 | 690 | 70 | 895 | 0.1022 | 0.278 | 0.86 | 4.89 | 117 | E | NA |
| 1-9 | 705 | 5 | 690 | 50 | 903 | 0.1404 | 0.190 | 0.95 | 12.83 | 176 | E | E |
| 1-10 | 705 | 5 | 690 | 50 | 895 | 0.1030 | 0.276 | 0.87 | 5.03 | 119 | E | NA |
| 1-11 | 705 | 5 | 690 | 50 | 892 | 0.0854 | 0.267 | 0.88 | 5.28 | 125 | E | NA |
| 1-12 | 705 | 5 | 690 | 50 | 909 | 0.1213 | 0.251 | 0.90 | 5.50 | 127 | E | NA |
| 1-13 | 705 | 5 | 690 | 50 | 906 | 0.1106 | 0.305 | 0.82 | 3.97 | 102 | NA | — |
| 1-14 | 690 | 60 | — | — | 906 | 0.1353 | 0.261 | 0.82 | 3.97 | 102 | NA | — |
| 1-15 | 690 | 60 | — | — | 904 | 0.1382 | 0.257 | 0.83 | 4.07 | 103 | NA | — |
| 1-16 | 705 | 30 | — | — | 863 | 0.1290 | 0.294 | 0.79 | 3.37 | 95 | NA | — |
| 1-17 | 700 | 35 | 660 | 20 | 875 | 0.1360 | 0.249 | 0.81 | 3.86 | 104 | NA | — |
| 1-18 | 705 | 5 | 680 | 50 | 921 | 0.0937 | 0.305 | 0.81 | 3.80 | 97 | NA | — |
| 1-19 | 705 | 5 | 690 | 50 | 896 | 0.0762 | 0.419 | 0.79 | 3.56 | 100 | NA | — |
| 1-20 | 705 | 5 | 690 | 50 | 911 | 0.0177 | 1.914 | 0.78 | 2.97 | 73 | NA | — |
| 1-21 | 705 | 5 | 690 | 50 | 873 | 0.1289 | 0.303 | 0.82 | 3.80 | 86 | NA | — |
| 1-22 | 705 | 5 | 690 | 50 | 901 | 0.1292 | 0.262 | 0.81 | 4.30 | 95 | NA | — |
| 1-23 | 705 | 5 | 690 | 50 | 894 | 0.1466 | 0.218 | 0.85 | 4.67 | 61 | NA | — |
| 1-24 | 705 | 5 | 690 | 50 | 905 | 0.1362 | 0.265 | 0.85 | 4.75 | 48 | NA | — |

period from when the steel plate of each of the relevant test numbers excluding Test Numbers 1-14 to 1-16 was extracted from the heat treatment furnace used for the first tempering until the steel plate in question was inserted into the heat treatment furnace used for the second tempering was not more than 5 minutes for each of the relevant test number.

[Evaluation Tests]

The steel plates of Test Numbers 1-1 to 1-24 that underwent tempering were subjected to a tensile test, a test to measure the Cr concentration in precipitates having an equivalent circular diameter of 20 nm or more, a fine precipitates numerical proportion measurement test, a Charpy impact test and an SSC resistance test that are described hereunder.

[Tensile Test]

The steel plates of Test Numbers 1-1 to 1-24 were subjected to the tensile test described above. Specifically, the tensile test was performed in conformity with ASTM E8/E8M. (2013). Round bar tensile test specimens having a parallel portion diameter of 4 mm and a parallel portion length of 35 mm were prepared from the center portion of the thickness of the steel plates of Test Numbers 1-1 to 1-24, The axial direction of the round bar tensile test specimens was parallel to the rolling direction of the steel plate, Tensile tests were performed in the atmosphere at normal temperature (25° C.) using each round bar test specimens of Test Numbers 1-1 to 1-24, and the yield strengths (MPa) off the steel plates of Test Numbers 1-1 to 1-24 were obtained. Note that, in the present examples, 0.2% offset proof stress obtained in the tensile test was defined as the yield strength for each test number. The obtained yield strength of the respective Test Numbers 1-1 to 1-24 is shown in Table 2 as "YS (MPa)".

[Test to Measure Cr Concentration in Precipitates having Equivalent Circular Diameter of 20 nm or More]

The Cr concentration in precipitates having an equivalent circular diameter of 20 nm or more in the respective steel plates of Test Numbers 1-1 to 1-24 was measured and calculated by the measurement method described above, Note that, the TEM used was JEM-2010 manufactured by JEOL Ltd., and the acceleration voltage was set to 200 kV. The Cr concentration in precipitates having an equivalent circular diameter of 20 nm or more in the steel plates of Test Numbers 1-1 to 1-24 are shown in Table 2 as "$\theta_{Cr}$ (mass fraction)". In addition, Fn1 that was determined based on the chemical composition and $\theta_{Cr}$ of respective Test Numbers 1-1 to 1-24 is shown in Table 2.

[Equivalent Circular Diameter of Precipitates Measurement Test]

For the respective steel plates of Test Numbers 1-1 to 1-24, by the measurement method described above, the numerical proportion of precipitates having an equivalent circular diameter within a range of 20 to 300 nm among precipitates having an equivalent circular diameter of 20 nm or more (numerical proportion of fine precipitates $NP_F$) and the number density of precipitates having an equivalent circular diameter of 300 nm or more (number density of coarse precipitates $ND_C$) (particles/$\mu m^2$) were calculated. Note that, the SEM used was model ERA-8900F manufactured by ELIONIX INC., and the acceleration voltage was set to 5 kV and the working distance was set to 15 mm. The observation visual field was set to 12 μm×9 μm (magnification of ×10000), and three visual fields were observed. The area fraction S (%) of precipitates in the observation visual field was determined as the volume ratio $V_{74}$ (%) of cementite obtained by thermodynamic calculation using the chemical composition of the steel plate of each test number and the first and second tempering temperatures. Note that, thermodynamic calculation was performed using a thermodynamic calculation software named. Thermo-Calc (available from Thermo-Calc Software, version 2017a), and TCFE8 was used as the database.

The numerical proportion of fine precipitates $NP_F$ was determined based on the total of the number of precipitates having an equivalent circular diameter of 20 nm or more and the total of the number of precipitates having an equivalent circular diameter within a range of 20 to 300 nm that were obtained in the three visual fields. Further, the number density of coarse precipitates $ND_C$ (particles/$\mu m^2$) was determined based on the sum of the numbers of precipitates having an equivalent circular diameter of 300 nm or more and the gross area of the three visual fields. The Fn3 (=$NP_F/ND_C$) was determined based on the obtained numerical proportion of fine precipitates $NP_F$ and the obtained number density of coarse precipitates $ND_C$ (particles/$\mu m^2$). The numerical proportion of fine precipitates $NP_F$ and Fn3 of the respective Test Numbers 1-1 to 1-24 is shown in Table 2.

[Charpy Impact Test]

A Charpy impact test in conformity with JIS Z 2242 (2005) was performed on the respective steel plates of Test Numbers 1-1 to 1-24, and the low-temperature toughness was evaluated. Specifically, a V-notch test specimens having a width of 10 mm, a thickness of 10 mm and a length of 55 mm were prepared from the center portion of the thickness of the steel plates of Test Numbers 1-1 to 1-24. The longitudinal direction of the test specimen was parallel to the plate width direction. The notched surfaces of the test specimens were perpendicular to the rolling direction of the steel plate. Five test specimens that were prepared were cooled to −75° C. A Charpy impact test in conformity with JIS Z 2242 (2005) was performed on the cooled test specimens, and the absorbed energy (J) was determined. The arithmetic average value of the absorbed energy determined for each of the five test specimens was defined as the absorbed energy vE(−75° C.)(J). The absorbed energy vE(−75° C.)(J) of the respective steel plates of Test Numbers 1-1 to 1-24 is shown in Table 2.

[SSC Resistance Test]

The SSC resistance of the respective steel plates of Test Numbers 1-1 to 1-24 was evaluated by a method performed in accordance with "Method A" specified in NACE TM0177-2005. Specifically, round bar test specimens having a diameter of 635 mm and a parallel portion length of 25.4 mm were prepared from the center portion of the thickness of the steel plates of Test Numbers 1-1 to 1-24. The round bar test specimen was prepared in a manner so that the axial direction thereof was parallel to the rolling direction of the steel plate. Tensile stress was applied in the axial direction of the round bar test specimens of the respective test numbers. At this time, the applied stress was adjusted so as to be 90% of the actual yield stress (90% AYS) of each steel plate of the respective test numbers.

A mixed aqueous solution containing 5.0 mass % of sodium chloride and 0.5 mass % of acetic acid (NACE solution A) was used as the test solution. The test solution at 24° C. was poured into three test vessels, and these were adopted as test baths. Three round bar test specimens to which the stress was applied were immersed individually in mutually different test vessels as the test baths. After each test bath was degassed, $H_2S$ gas at 1 atm was blown into the respective test baths and caused to saturate. The test baths in which the gaseous mixture was saturated were held at 2° C. for 720 hours.

After being held for 720 hours, the round bar test specimens of each test number were observed to determine whether or not sulfide stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The steel plates of Test Numbers 1-1 to 1-12 were further subjected to a similar test in conformity with Method A specified in NACE TM0177-2005, in which the stress applied to the round bar test specimens was made 95% of the actual yield stress (95% AYS) of the steel plates of the respective test numbers. Similarly to the aforementioned method, the round bar test specimens were held at 24° C. for 720 hours. After being held for 720 hours, the round bar test specimens of the respective test numbers were observed to determine whether or not sulfide stress cracking (SSC) had occurred. Specifically, after being held for 720 hours, the test specimens were observed with the naked eye and using a projector with a magnification of ×10, Steel plates for which cracking was not confirmed in all three of the test, specimens as the result of the observation were determined as being "E". On the other hand, steel plates for which cracking was confirmed in at least one test specimen were determined as being "NA".

[Test Results]

The test results are shown in Table 2.

Referring to Table 1 and Table 2, the chemical composition of the respective steel plates of Test Numbers 1-1 to 1-12 was appropriate, and the yield strength was within the range of 862 to less than 965 MPa. (125 ksi grade). In addition, Fn1 was not more than 0.300, and Fn2 was not more than 0.355. Furthermore, the numerical proportion of fine precipitates $NP_F$ was 0.85 or more. As a result, the absorbed enemy vE(−75° C.) was 105 J or more, and the aforementioned steel plates exhibited excellent low-temperature toughness. In addition, the aforementioned steel plates exhibited excellent SSC resistance in the SSC resistance test in which the applied stress was 90% of the actual yield stress 190% AYS).

Furthermore, in the steel plates of Test Numbers 1-2, 1-4, 1-6, 1-7 and 1-9, Fn2 was not more than 0.300. Fn1 was not more than 0.240, and the numerical proportion of fine precipitates $NP_F$ was 0.92 or more. As a result, the steel plates of Test Numbers 1-2, 1-4, 1-6, 1-7 and 1-9 exhibited excellent SSC resistance even in the SSC resistance test in which the applied stress was 95% of the actual yield stress (95% AYS).

On the other hand, in the steel plate of Test Number 1-13, Fn1 was more than 0.300. In addition, Fn2 was more than 0.355. As a result, the numerical proportion of fine precipitates $NP_F$ was less than 0.85. Consequently, the absorbed energy vE(−75° C.) was less than 105 J and the steel plate of Test Number 1-13 did not exhibit excellent low-temperature toughness. In addition, the steel plate of Test Number 1-13 did not exhibit excellent SSC resistance in the SSC resistance test with 90% AYS.

For the steel plates of Test Numbers 1-14 and 1-15, the tempering temperature in the first tempering was too low. In addition, the tempering time of the first tempering was too long. Furthermore, a second tempering was not performed. As a result, the numerical proportion of fine precipitates $NP_F$ was less than 0.85. Consequently, the absorbed energy vE(−75° C.) was less than 105 J and the steel plates of Test Numbers 1-14 and 1-15 did not exhibit excellent low-temperature toughness. In addition, the steel plates of Test Numbers 1-14 and 1-15 did not exhibit excellent SSC resistance in the SSC resistance test with 90% AYS.

For the steel plate of Test Number 1-16, the tempering time of the first tempering was too long. In addition, a second tempering was not performed. As a result, the numerical proportion of fine precipitates $NP_F$ was less than 0.85. Consequently, the absorbed energy vE(−75° C.) was less than 105 J, and the steel plate of Test Number 1-16 did not exhibit excellent low-temperature toughness. In addition, the steel plate of Test Number 1-16 did not exhibit excellent SSC resistance in the SSC resistance test with 90% AYS.

For the steel plate of Test. Number 1-17, the tempering time of the first tempering was too lone. As a result, the numerical proportion of fine precipitates $NP_F$ was less than 0.85. Consequently, the absorbed energy vE(−75° C.) was less than 105 J, and the steel plate of Test Number 1-17 did not exhibit excellent low-temperature toughness. In addition, the steel plate of Test Number 1-17 did not exhibit excellent SSC resistance in the SSC resistance test with 90% AYS.

In the steel plates of Test Numbers 1-18 and 1-19, Fn1 was more than 0.300. In addition, Fn2 was more than 0.355. As a result, the numerical proportion of fine precipitates $NP_F$ was less than 0.85. Consequently, the absorbed energy vE(−75° C.) was less than 105 J, and the steel plates of Test Numbers 1-18 and 1-19 did not exhibit excellent low-temperature toughness. In addition, the steel plates of Test Numbers 1-18 and 1-19 did not exhibit excellent SSC resistance in the SSC resistance test with 90% AYS.

In the steel plate of Test Number 1-20, the Cr content was too low. In addition, Fn1 was more than 0.300. Furthermore, Fn2 was more than 0.355. As a result, the numerical proportion of fine precipitates $NP_F$ was less than 0.85. Consequently, the absorbed energy vE(−75° C.) was less than 105 J, and the steel, plate of Test Number 1-20 did not exhibit excellent low-temperature toughness. In addition, the steel plate of Test Number 1-20 did not exhibit excellent SSC resistance in the SSC resistance test with 90% AYS.

In the steel plate of Test Number 1-21, the Mo content was too low. In addition, Fn1 was more than 0.300. Furthermore, Fn2 was more than 0.355. As a result, the numerical proportion of fine precipitates $NP_F$ was less than 0.85. Consequently, the absorbed energy vE(−75° C.) was less than 105 J, and the steel plate of Test Number 1-21 did not exhibit excellent low-temperature toughness. In addition, the steel plate of Test Number 1-21 did not exhibit excellent SSC resistance in the SSC resistance test with 90% AYS.

In the steel plate of Test Number 1-22, the Mn content was too high. As a result, the numerical proportion of fine precipitates $NP_F$ was less than 0.85. Consequently, the absorbed energy vE(−75° C.) was less than 105 J, and the steel plate of Test Number 1-22 did not exhibit excellent low-temperature toughness. In addition, the steel plate of Test Number 1-22 did not exhibit excellent SSC resistance in the SSC resistance test with 90% AYS.

In the steel plate of Test Number 1-23, the N content was too high. Consequently, the absorbed energy vE(−75° C.) was less than 105 J, and the steel plate of Test Number 1-23 did not exhibit excellent low-temperature toughness. In addition, the steel plate of Test Number 1-23 did not exhibit excellent SSC resistance in the SSC resistance test with 90% AYS.

In the steel plate of Test Number 1-24, the P content was too high. Consequently, the absorbed energy vE(−75° C.) was less than 105 J, and the steel plate of Test Number 1-24 did not exhibit excellent low-temperature toughness. In addition, the steel plate of Test Number 1-24 did not exhibit excellent SSC resistance in the SSC resistance test with 90% AYS.

EXAMPLE 2

In Example 2, the steel material being intended to have the yield strength of the steel material is of 140 ksi grade (965 to 1069 MPa) was investigated. Specifically, molten steels of a weight of 180 kg having the chemical compositions shown in Table 3 were produced. In addition, En2 that was determined based on the obtained chemical composition and Formula (2) is shown in Table 3. Note that, "-" in Table 3 means that content of each element is at the level of an impurity.

Ingots were produced using the molten steel of Test Numbers 2-1 to 2-24, The produced ingots were hot roiled to produce steel plates having a thickness of 15 mm. The steel plates of Test Numbers 2-1 to 2-24 after hot rolling were allowed to cool to bring the steel plate temperature to normal temperature (25° C.). After being allowed to cool, the steel plates of Test Numbers 2-1 to 2-24 were held for 20 minutes at the quenching temperature (920° C.), the steel plates were immersed in a water bath to be quenched. At this time, the cooling rate during quenching ($CR_{800-500}$) was 600° C./min for each test number. Note that, a type K thermocouple of a sheath type was inserted into a center portion of the thickness of the steel plate in advance, and the quenching temperature and cooling rate during quenching $CR_{800-500}$ were measured using the type K thermocouple.

TABLE 3

| Test | Chemical Composition (Unit is mass %; balance is Fe and impurities) | | | | | | | | | | | |
|---|---|---|---|---|---|---|---|---|---|---|---|---|
| Number | C | Si | Mn | P | S | Al | Cr | Mo | Ti | B | N | O |
| 2-1 | 0.30 | 0.36 | 0.34 | 0.007 | 0.0009 | 0.054 | 1.04 | 1.22 | 0.014 | 0.0014 | 0.0042 | 0.0015 |
| 2-2 | 0.26 | 0.35 | 0.12 | 0.006 | 0.0007 | 0.043 | 0.68 | 0.75 | 0.010 | 0.0012 | 0.0043 | 0.0018 |
| 2-3 | 0.29 | 0.34 | 0.25 | 0.009 | 0.0008 | 0.037 | 0.88 | 0.98 | 0.011 | 0.0015 | 0.0046 | 0.0010 |
| 2-4 | 0.32 | 0.33 | 0.05 | 0.006 | 0.0007 | 0.031 | 0.97 | 1.23 | 0.010 | 0.0013 | 0.0034 | 0.0018 |
| 2-5 | 0.27 | 0.30 | 0.45 | 0.006 | 0.0006 | 0.036 | 0.81 | 0.87 | 0.011 | 0.0015 | 0.0036 | 0.0012 |
| 2-6 | 0.26 | 0.26 | 0.45 | 0.007 | 0.0010 | 0.048 | 1.00 | 1.18 | 0.012 | 0.0014 | 0.0036 | 0.0010 |
| 2-7 | 0.31 | 0.34 | 0.13 | 0.011 | 0.0007 | 0.040 | 1.21 | 0.54 | 0.009 | 0.0011 | 0.0023 | 0.0011 |
| 2-8 | 0.28 | 0.30 | 0.32 | 0.007 | 0.0006 | 0.038 | 0.75 | 1.03 | 0.013 | 0.0013 | 0.0023 | 0.0006 |
| 2-9 | 0.26 | 0.24 | 0.26 | 0.011 | 0.0007 | 0.030 | 0.77 | 1.18 | 0.013 | 0.0015 | 0.0031 | 0.0010 |
| 2-10 | 0.27 | 0.30 | 0.47 | 0.006 | 0.0010 | 0.026 | 0.68 | 0.91 | 0.012 | 0.0015 | 0.0032 | 0.0017 |
| 2-11 | 0.30 | 0.31 | 0.42 | 0.009 | 0.0010 | 0.047 | 0.90 | 0.85 | 0.009 | 0.0011 | 0.0033 | 0.0014 |
| 2-12 | 0.27 | 0.29 | 0.45 | 0.008 | 0.0010 | 0.025 | 0.97 | 1.05 | 0.013 | 0.0011 | 0.0037 | 0.0011 |
| 2-13 | 0.32 | 0.27 | 0.49 | 0.012 | 0.0008 | 0.048 | 0.61 | 0.62 | 0.012 | 0.0011 | 0.0029 | 0.0015 |
| 2-14 | 0.32 | 0.39 | 0.46 | 0.010 | 0.0006 | 0.036 | 1.12 | 0.91 | 0.014 | 0.0012 | 0.0023 | 0.0014 |
| 2-15 | 0.31 | 0.26 | 0.42 | 0.007 | 0.0008 | 0.032 | 1.24 | 0.52 | 0.013 | 0.0013 | 0.0039 | 0.0010 |
| 2-16 | 0.33 | 0.27 | 0.49 | 0.007 | 0.0010 | 0.048 | 1.14 | 0.89 | 0.015 | 0.0011 | 0.0047 | 0.0016 |
| 2-17 | 0.32 | 0.30 | 0.43 | 0.010 | 0.0006 | 0.042 | 1.22 | 1.02 | 0.013 | 0.0014 | 0.0025 | 0.0009 |
| 2-18 | 0.22 | 0.28 | 0.52 | 0.007 | 0.0010 | 0.043 | 0.50 | 0.96 | 0.013 | 0.0012 | 0.0044 | 0.0015 |
| 2-19 | 0.32 | 0.34 | 0.23 | 0.007 | 0.0007 | 0.044 | 0.42 | 0.45 | 0.011 | 0.0014 | 0.0031 | 0.0016 |
| 2-20 | 0.26 | 0.31 | 0.30 | 0.009 | 0.0008 | 0.028 | 0.21 | 0.89 | 0.015 | 0.0012 | 0.0032 | 0.0008 |
| 2-21 | 0.32 | 0.28 | 0.46 | 0.007 | 0.0009 | 0.055 | 0.60 | 0.04 | 0.011 | 0.0012 | 0.0033 | 0.0007 |
| 2-22 | 0.24 | 0.32 | 1.53 | 0.012 | 0.0010 | 0.041 | 0.92 | 0.50 | 0.015 | 0.0015 | 0.0041 | 0.0008 |
| 2-23 | 0.26 | 0.31 | 0.39 | 0.009 | 0.0009 | 0.053 | 0.66 | 0.68 | 0.011 | 0.0011 | 0.0320 | 0.0012 |
| 2-24 | 0.30 | 0.33 | 0.35 | 0.055 | 0.0010 | 0.055 | 0.95 | 0.61 | 0.010 | 0.0011 | 0.0045 | 0.0007 |

| Test | Chemical Composition (Unit is mass %; balance is Fe and impurities) | | | | | | | | | | |
|---|---|---|---|---|---|---|---|---|---|---|---|
| Number | V | Nb | Ca | Mg | Zr | Nd | Co | W | Ni | Cu | Fn2 |
| 2-1 | — | — | — | — | — | — | — | — | — | — | 0.341 |
| 2-2 | 0.14 | — | — | — | — | — | — | — | — | — | 0.330 |
| 2-3 | 0.13 | — | — | — | — | — | — | — | — | — | 0.312 |
| 2-4 | 0.12 | 0.012 | — | — | — | — | — | — | — | — | 0.328 |
| 2-5 | 0.12 | — | 0.0018 | — | — | — | — | — | — | — | 0.308 |
| 2-6 | 0.16 | — | — | 0.0017 | — | — | — | — | — | — | 0.186 |
| 2-7 | 0.14 | — | — | — | 0.0017 | — | — | — | — | — | 0.306 |
| 2-8 | 0.16 | — | — | — | — | 0.0021 | — | — | — | — | 0.302 |
| 2-9 | 0.08 | — | — | — | — | — | 0.37 | — | — | — | 0.284 |
| 2-10 | 0.13 | — | — | — | — | — | — | 0.35 | — | — | 0.342 |
| 2-11 | 0.15 | — | — | — | — | — | — | — | 0.05 | — | 0.332 |
| 2-12 | 0.09 | — | — | — | — | — | — | — | — | 0.22 | 0.261 |
| 2-13 | 0.09 | — | — | — | — | — | — | — | — | — | 0.685 |
| 2-14 | 0.11 | — | — | — | — | — | — | — | — | — | 0.327 |
| 2-15 | 0.08 | 0.010 | — | — | — | — | — | — | — | — | 0.333 |
| 2-16 | 0.20 | — | — | — | — | — | — | — | — | — | 0.291 |
| 2-17 | 0.09 | — | — | — | — | — | — | — | — | — | 0.300 |
| 2-18 | — | 0.030 | — | — | — | — | — | — | — | — | 0.380 |
| 2-19 | 0.12 | — | — | — | — | — | — | — | — | — | 0.992 |
| 2-20 | 0.15 | — | — | — | — | — | — | — | — | — | 0.650 |
| 2-21 | 0.08 | — | — | — | — | — | — | — | — | — | 0.890 |
| 2-22 | 0.08 | — | — | — | — | — | — | — | — | — | 0.281 |
| 2-23 | 0.16 | — | — | — | — | — | — | — | — | — | 0.333 |
| 2-24 | 0.15 | — | — | — | — | — | — | — | — | — | 0.346 |

After quenching, the steel plates of Test Numbers 2-1 to 2-24 were subjected to a tempering process. For the steel plate of each test number excluding Test Numbers 2-14 to 2-16, a first tempering and a second tempering were performed. On the other hand, for the steel plates of Test Numbers 2-14 to 2-16, a tempering was performed only once. The tempering temperature and the tempering time performed for the steel plates of Test Numbers 2-1 to 2-24 for each of the first tempering and the second tempering are as shown in Table 4. Note that, "-" in the "Second Tempering" column in Table 4 means that the second tempering was not performed.

TABLE 4

| | First Tempering | | Second Tempering | | | | | | | | SSC Resistance | |
|---|---|---|---|---|---|---|---|---|---|---|---|---|
| Test Number | Tempering Temperature (° C.) | Tempering Time (min) | Tempering Temperature (° C.) | Tempering Time (min) | YS (MPa) | $\theta_{Cr}$ (mass fraction) | Fn1 | $NP_F$ | Fn3 | vE (−60° C.) (j) | 0.1 atm $H_2S$ | 0.2 atm $H_2S$ |
| 2-1 | 700 | 15 | 650 | 60 | 1033 | 0.1335 | 0.263 | 0.89 | 5.24 | 75 | E | NA |
| 2-2 | 700 | 5 | 670 | 50 | 993 | 0.0983 | 0.274 | 0.87 | 4.86 | 78 | E | NA |
| 2-3 | 710 | 5 | 660 | 40 | 1048 | 0.1196 | 0.249 | 0.93 | 6.99 | 74 | E | NA |
| 2-4 | 705 | 5 | 670 | 30 | 1009 | 0.1221 | 0.266 | 0.88 | 5.37 | 80 | E | NA |
| 2-5 | 700 | 5 | 670 | 50 | 998 | 0.1145 | 0.246 | 0.93 | 7.32 | 85 | E | NA |
| 2-6 | 700 | 5 | 670 | 50 | 986 | 0.1472 | 0.146 | 0.97 | 18.65 | 102 | E | E |
| 2-7 | 700 | 10 | 670 | 50 | 994 | 0.1463 | 0.250 | 0.93 | 6.84 | 83 | E | NA |
| 2-8 | 700 | 5 | 670 | 70 | 982 | 0.1061 | 0.248 | 0.93 | 7.32 | 93 | E | NA |
| 2-9 | 700 | 5 | 670 | 50 | 996 | 0.1094 | 0.233 | 0.95 | 8.33 | 87 | E | E |
| 2-10 | 700 | 5 | 670 | 50 | 993 | 0.0989 | 0.277 | 0.91 | 5.69 | 79 | E | NA |
| 2-11 | 700 | 5 | 670 | 50 | 1001 | 0.1207 | 0.262 | 0.92 | 5.97 | 82 | E | NA |
| 2-12 | 700 | 5 | 670 | 50 | 994 | 0.1362 | 0.204 | 0.96 | 9.70 | 98 | E | E |
| 2-13 | 700 | 5 | 670 | 50 | 1007 | 0.0754 | 0.531 | 0.82 | 3.69 | 59 | NA | — |
| 2-14 | 670 | 60 | — | — | 1012 | 0.1382 | 0.260 | 0.81 | 3.75 | 65 | NA | — |
| 2-15 | 670 | 60 | — | — | 1010 | 0.1415 | 0.280 | 0.81 | 3.70 | 64 | NA | — |
| 2-16 | 700 | 30 | — | — | 921 | 0.1325 | 0.252 | 0.80 | 3.60 | 64 | E | — |
| 2-17 | 700 | 35 | 650 | 30 | 918 | 0.1447 | 0.247 | 0.83 | 3.90 | 69 | E | — |
| 2-18 | 700 | 5 | 660 | 50 | 1003 | 0.0775 | 0.328 | 0.82 | 3.80 | 61 | NA | — |
| 2-19 | 700 | 5 | 670 | 50 | 1013 | 0.0527 | 0.766 | 0.77 | 2.91 | 54 | NA | — |
| 2-20 | 700 | 5 | 670 | 50 | 990 | 0.0326 | 0.777 | 0.76 | 2.76 | 44 | NA | — |
| 2-21 | 700 | 5 | 670 | 50 | 1009 | 0.0690 | 0.670 | 0.79 | 3.24 | 42 | NA | — |
| 2-22 | 700 | 5 | 670 | 50 | 984 | 0.1175 | 0.247 | 0.86 | 6.32 | 70 | NA | — |
| 2-23 | 700 | 5 | 670 | 50 | 998 | 0.0957 | 0.278 | 0.88 | 4.92 | 20 | NA | — |
| 2-24 | 700 | 5 | 670 | 50 | 1002 | 0.1186 | 0.286 | 0.85 | 4.52 | 11 | NA | — |

Here, the heating rate during tempering ($HR_{100-650}$) in the first tempering was 10° C./min for Test Numbers 2-1 to 2-24. Note that, a type K thermocouple of a sheath type was inserted into a center portion of the thickness of the steel plate in advance, and the tempering temperature and the heating rate during tempering $HR_{100-650}$ were measured using the type K thermocouple. Also, in the present example, the tempering temperature was the temperature of the heat treatment furnace where the tempering is performed. Further, in the present example, the tempering time was taken as the period of time from the temperature of the steel plate of each test number reaching a predetermined tempering temperature till the extracting from the heat treatment furnace.

For the steel plate of each test number excluding Test Numbers 2-14 to 2-16, the first tempering and the second tempering were performed using different heat treatment furnaces. Specifically, the steel plate of each test number excluding Test Numbers 2-14 to 2-16 was subjected to the first tempering, and thereafter was extracted from the heat treatment furnace. The extracted steel plate of each test number excluding Test Numbers 2-14 to 2-16 was allowed to cool in the atmosphere, and immediately after reaching the second tempering temperature the steel plate in question was inserted into a different heat treatment furnace whose temperature had been adjusted for use for the second tempering, and second tempering was performed. Note that, the time period from when the steel plate of each of the relevant test numbers excluding Test Numbers 2-14 to 2-16 was extracted from the heat treatment furnace used for the first tempering until the steel plate in question was inserted into the heat treatment furnace used for the second tempering was not more than 5 minutes for each of the relevant test number.

[Evaluation Tests]

The steel plates of Test Numbers 2-1 to 2-24 that underwent tempering were subjected to a tensile test, a test to measure the Cr concentration in precipitates having an equivalent circular diameter of 20 nm or more, a fine precipitates numerical proportion measurement test, a Charpy impact test and an SSC resistance test that are described hereunder.

[Tensile Test]

The steel plates of Test Numbers 2-1 to 2-24 were subjected to the tensile test described above. Specifically, the tensile test was performed in conformity with ASTM E8/E8M (2013). Round bar tensile test specimens having a parallel portion diameter of 4 mm and a parallel portion length of 35 mm were prepared from the center portion of the thickness of the steel plates of Test Numbers 2-1 to 2-24. The axial direction of the round bar tensile test specimens was parallel to the rolling direction of the steel plate. Tensile tests were performed in the atmosphere at normal temperature (25° C.) using each round bar test specimens of Test Numbers 2-1 to 2-24, and the yield strengths (MPa) of the steel plates of Test Numbers 2-1 to 2-24 were obtained. Note that, in the present examples, 0.2% offset proof stress obtained in the tensile test was defined as the yield strength for each test number. The obtained yield strength of the respective Test Numbers 2-1 to 2-24 is shown in Table 4 as "YS (MPa)".

[Test to Measure Cr Concentration in Precipitates having Equivalent Circular Diameter of 20 nm or More]

The Cr concentration in precipitates having an equivalent circular diameter of 20 nm or more in the respective steel plates of Test Numbers 2-1 to 2-24 was measured and calculated by the measurement method described above. Note that, the TEM used was JEM-2010 manufactured by JEOL Ltd., and the acceleration voltage was set to 200 kV. The Cr concentration in precipitates having an equivalent circular diameter of 20 nm or more in the steel plates of Test Numbers 2-1 to 2-24 are shown in. Table 4 as "$\theta_{Cr}$ (mass fraction)". In addition, Fn1 that was determined based on the chemical composition and $\theta_{Cr}$ of respective Test Numbers 2-1 to 2-24 is shown in Table 4.

[Equivalent Circular Diameter of Precipitates Measurement Test]

For the respective steel plates of Test Numbers 2-1 to 24, by the measurement method described above, the numerical proportion of precipitates having an equivalent circular diameter within a range of 20 to 300 nm among precipitates having an equivalent circular diameter of 20 nm or more (numerical proportion of fine precipitates $NP_F$) and the number density of precipitates having an equivalent circular diameter of 300 nm or more (number density of coarse precipitates $ND_C$) (particles/$\mu m^2$) were calculated. Note that, the SEM used was model ERA-8900FE manufactured by ELIONIX INC., and the acceleration voltage was set to 5 kV and the working distance was set to 15 mm. The observation visual field was set to 12 μmμ9 μm (magnification of ×10000), and three visual fields were observed. The area fraction S (%) of precipitates in the observation visual field was determined as the volume ratio $V_\theta$(%) of cementite obtained by thermodynamic calculation using the chemical composition of the steel plate of each test number and the first and second tempering temperatures. Note that, thermodynamic calculation was performed using a thermodynamic calculation software named. Thermo-Calc (available from Thermo-Calc Software, version 2017a), and TCFE8 was used as the database.

The numerical proportion of fine precipitates $NP_F$ was determined based on the total of the number of precipitates having an equivalent circular diameter of 20 nm or more and the total of the number of precipitates having an equivalent circular diameter within a range of 20 to 300 nm that were obtained in the three visual fields. Further, the number density of coarse precipitates $ND_C$ (particles/$\mu m^2$) was determined based on the sum of the numbers of precipitates having an equivalent circular diameter of 300 nm or more and the gross area of the three visual fields. The Fn3 (=$NP_F/ND_C$) was determined based on the obtained numerical proportion of fine precipitates $NP_F$ and the obtained number density of coarse precipitates $ND_C$ (particles/$\mu m^2$). The numerical proportion of hue precipitates $NP_F$ and Fn3 of the respective Test Numbers 2-1 to 2-24 is shown in Table 4.

[Charpy Impact Test]

A Charpy impact test in conformity with JIS Z 2242 (2005) was performed on the respective steel plates of Test Numbers 2-1 to 2-24, and the low-temperature toughness was evaluated. Specifically, a V-notch test specimens having a width of 10 mm, a thickness of 10 mm and a length of 55 mm were prepared from the center portion of the thickness of the steel plates of Test Numbers 2-1 to 2-24. The longitudinal direction of the test specimen was parallel to the plate width direction. The notched surfaces of the test specimens were perpendicular to the rolling direction of the steel plate. Five test specimens that were prepared were cooled to −60° C. A Charpy impact test in conformity with JIS Z 2242 (2005) was performed on the cooled test specimens, and the absorbed energy (J) was determined. The arithmetic average value of the absorbed energy determined for each of the five test specimens was defined as the absorbed energy vE(−60° C.)(J). The absorbed energy vE(−60° C.)(J) of the respective steel plates of Test Numbers 2-1 to 2-24 is shown in Table 4.

[SSC Resistance Test]

The SSC resistance of the respective steel plates of Test Numbers 2-1 to 2-24 was evaluated by a method performed in accordance with "Method A" specified in NACE TM0177-2005. Specifically, round bar test specimens having a diameter of 635 mm and a parallel portion, length of 25.4 mm were prepared from the center portion of the thickness of the steel plates of Test Numbers 2-1 to 2-24. The round bar test specimen was prepared in a manner so that the axial direction thereof was parallel to the rolling direction of the steel plate. Tensile stress was applied in the axial direction of the round bar test specimens of the respective test numbers. At this time, the applied stress was adjusted so as to be 90% of the actual yield stress of each steel plate of the respective test numbers.

A mixed aqueous solution containing 5.0 mass % of sodium chloride and 0.4 mass % of sodium acetate that is adjusted to pH 3.5 using acetic acid (NACE solution B) was used as the test solution. The test Solution at 24° C. was poured into three test vessels, and these were adopted as test baths. Three round bar test specimens to which the stress was applied were immersed individually in mutually different test vessels as the test baths. After each test bath was degassed, a mixed gas of $H_2S$ gas at 0.1 atm pressure and $CO_2$ gas at 0.9 atm pressure was blown into the respective test baths and caused to saturate. The test baths M which the gaseous mixture was saturated were held at 24° C. for 720 hours.

After being held for 720 hours, the round bar test specimens of each test number were observed to determine whether or not sulfide Stress cracking (SSC) had occurred. Specifically, after being immersed for 720 hours, the round bar test specimens were observed with the naked eye and using a projector with a magnification of ×10. Steel plates for which cracking was not confirmed in all three of the round bar test specimens as the result of the observation were determined as being "E" (Excellent). On the other hand, steel plates for which cracking was confirmed in at least one round bar test specimen were determined as being "NA" (Not Acceptable).

The steel plates of Test Numbers 2-1 to 2-12 were further subjected to a similar test in conformity with Method A specified in NACE TM0177-2005, in which the blown gas was made a mixed gas of $H_2S$ gas at 0.2 atm pressure and $CO_2$ gas at 0.8 atm pressure. Similarly to the aforementioned method, the round bar test specimens were held at 24° C. for 720 hours, After being held for 720 hours, the round bar test specimens of the respective test numbers were observed to determine whether or not sulfide stress cracking (SSC) had occurred, Specifically, after being held for 720 hours, the test specimens were observed with the naked eye and using a projector with a magnification of ×10. Steel plates for which cracking was not confirmed in all three of the test specimens as the result of the observation were determined as being "E". On the other hand, steel plates for which cracking was confirmed in at least one test specimen were determined as being "NA".

[Test Results]

The test results are shown in Table 4.

Referring to Table 3 and Table 4, the chemical composition of the respective steel plates of Test Numbers 2-1 to 2-12 was appropriate, and the yield strength was within the range of 965 to 1069 MPa (140 ksi grade). In addition, Fn1 was not more than 0.300, and Fn2 was not more than 0.355. Furthermore, the numerical proportion of fine precipitates $NP_F$ was 0.85 or more. As a result, the absorbed energy vE(−60° C.) was 70 J or more, and the aforementioned steel plates exhibited excellent low-temperature toughness. In addition, the aforementioned steel plates exhibited excellent SSC resistance in the SSC resistance test with 0.1 atm $H_2S$.

Furthermore, in the steel plates of Test Numbers 2-6, 2-9 and 2-12, Fn2 was not more than 0.300, Fn1 was not more than 0.240, and the numerical proportion of fine precipitates $NP_F$ was 0.94 or more. As a result, the steel plates of Test Numbers 2-6, 2-9 and 2-12 exhibited excellent SSC resistance even in the SSC resistance test with 0.2 atm $H_2S$.

On the other hand, in the steel plate of Test Number 2-13, Fn1 was more than 0.300. In addition, Fn2 was more than 0.355. As a result, the numerical proportion of fine precipitates $NP_F$ was less than 0.85. Consequently, the absorbed energy vE(−60° C.) was less titan 70 J, and the steel plate of Test Number 2-13 did not exhibit excellent low-temperature toughness. In addition, the steel plate of Test Number 2-13 did not exhibit excellent SSC resistance in the SSC resistance test with 0.1 atm $H_2S$.

For the steel plates of Test Numbers 2-14 and 2-15, the tempering temperature in the first tempering was too low. In addition, the tempering time of the first tempering was too tong. Furthermore, a second tempering was not performed. As a result, the numerical proportion of fine precipitates $NP_F$ was less than 0.85. Consequently, the absorbed energy vE(−60° C.) was less than 70 J, and the steel plates of Test Numbers 2-14 and 2-15 did not exhibit excellent low-temperature toughness. In addition, the steel plates of Test Numbers 2-14 and 2-15 did not exhibit excellent SSC resistance in the SSC resistance test with 0.1 atm $H_2S$.

For the steel plate of Test Number 2-16, the tempering time of the first tempering was too long. In addition, a second tempering was not performed. As a result, the yield strength was less than 965 MPa. Consequently, the steel plate of Test Number 2-16 did not have the yield strength of 140 ksi grade. In addition, the numerical proportion of fine precipitates $NP_F$ was less than 0.85, Consequently, the absorbed energy vE(−60° C.) was less than 70 J, and the steel plate of Test Number 2-16 did not exhibit excellent low-temperature toughness.

For the steel plate of Test Number 2-17, the tempering time of the first tempering was too long. As a result the yield strength was less than 965 MPa. Consequently, the steel plate of Test Number 2-17 did not have the yield strength of 140 ksi grade. In addition, the numerical proportion of fine precipitates $NP_F$ was less than 0.85. Consequently, the absorbed energy vE(−60° C.) was less than 70 J, and the steel plate of Test Number 2-16 did not exhibit excellent low-temperature toughness.

In the steel plates of Test Numbers 2-18 and 2-19, Fn1 was more than 0.300. In addition, Fn2 was more than 0.355. As a result, the numerical proportion of fine precipitates $NP_F$ was less than 0.85. Consequently, the absorbed energy vE(−60° C.) was less, than 70 J, and the steel plates of Test Numbers 2-18 and 2-19 did not exhibit excellent low-temperature toughness. In addition, the steel plates of Test Numbers 2-18 and 2-19 did not exhibit excellent SSC resistance in the SSC resistance test with 0.1 atm $H_2S$.

In the steel plate of Test Number 2-20, the Cr content was too low. In addition, Fn1 was more than 0.300. Furthermore, Fn2 was more than 0.355. As a result, the numerical proportion of fine precipitates $NP_F$ was less than 0.85. Consequently, the absorbed energy vE(−60° C.) was less than 70 J, and the steel plate of Test Number 2-20 did not exhibit excellent low-temperature toughness. In addition, the steel plate of Test Number 2-20 did not exhibit excellent SSC resistance in the SSC resistance test with 0.1 atm $H_2S$.

In the steel plate of Test Number 2-21, the Mo content was too low. In addition, Fn1 was more than 0.300. Furthermore, Fn2 was more than 0.355. As a result, the numerical proportion of fine precipitates $NP_F$ was less than 0.85. Consequently, the absorbed energy vE(−60° C.) was less than 70 J, and the steel plate of Test Number 2-21 did not exhibit excellent low-temperature toughness. In addition, the steel plate of Test Number 2-21 did not exhibit excellent SSC resistance in the SSC resistance test with 0.1 atm $H_2S$.

In the steel plate of Test Number 2-22, the Mn content was too high. As a result, the steel plate of Test Number 2-22 did not exhibit excellent SSC resistance in the SSC resistance test with 0.1 atm $H_2S$.

In the steel plate of Test Number 2-23, the N content was too high. Consequently, the absorbed energy vE(−60° C.) was less than 70 J, and the steel plate of Test Number 2-23 did not exhibit excellent low-temperature toughness. In addition, the steel plate of Test Number 2-23 did not exhibit excellent SSC resistance in the SSC resistance test with 0.1 atm $H_2S$.

In the steel plate of Test Number 2-24, the P content was too high. Consequently, the absorbed energy vE(−60° C.) was less than 70 J, and the steel plate of Test Number 2-24 did not exhibit excellent low-temperature toughness. In addition, the steel plate of Test Number 2-24 did not exhibit excellent SSC resistance in the SSC resistance test with 0.1 atm $H_2S$.

An embodiment of the present disclosure has been described above. However, the embodiment described above is merely an example for implementing the present disclosure. Accordingly, the present disclosure is not limited to the above embodiment, and the above embodiment can be appropriately modified and performed within a range that does not deviate from the gist of the present invention.

INDUSTRIAL APPLICABILITY

The steel material according to the present disclosure is widely applicable to steel materials to be utilized in a severe environment such as a polar region, and preferably can be utilized as a steel material that is utilized in an oil well environment, and further preferably can be utilized as a steel material for casing, tubing or line pipes or the like.

The invention claimed is:

1. A steel material comprising a chemical composition consisting of, in mass %, C: more than 0.20 to 0.35%, Si: 0.05 to 1.00%, Mn: 0.02 to 1.00%, P: 0.025% or less, S: 0.0100% or less, Al: 0.005 to 0.100%, Cr: 0.40 to 1.50%, Mo: 0.30 to 1.50%, Ti: 0.002 to 0.050%, B: 0.0001 to 0.0050%, N: 0.0100% or less, O: 0.0100% or less, V: 0 to 0.60%,
Nb: 0 to 0.030%,
Ca: 0 to 0.0100%,
Mg: 0 to 0.0100%,
Zr: 0 to 0.0100%,
rare earth metal: 0 to 0.0100%,
Co: 0 to 0.50%,
W: 0 to 0.50%,
Ni: 0 to 0.10%,
Cu: 0 to 0.50%, and
with the balance being Fe and impurities, and
a yield strength of 862 MPa or more,
wherein
the steel material satisfies Formula (1) and Formula (2),
in the steel material, a numerical proportion of precipitates having an equivalent circular diameter within a range of 20 to 300 nm among precipitates having an equivalent circular diameter of 20 nm or more is 0.85 or more:

$$(0.157\times C-0.0006\times Cr-0.0098\times Mo-0.0482\times V+0.0006)/\theta_{Cr}\leq 0.300 \quad (1)$$

$$(1+263\times C-Cr-16\times Mo-80\times V)/(98-358\times C+159\times Cr+15\times Mo+96\times V)\leq 0.355 \quad (2)$$

where, a content in mass % of a corresponding element is substituted for each symbol of an element in Formula (1) and Formula (2), and if a corresponding element is not contained, 0 is substituted for the symbol of the relevant element, and a Cr concentration in mass fraction in precipitates having an equivalent circular diameter of 20 nm or more is substituted for $\theta_{Cr}$ in Formula (1).

2. The steel material according to claim 1, wherein the chemical composition contains one or more types of elements selected from the group consisting of:
V: 0.01 to 0.60%, and
Nb: 0.002 to 0.030%.

3. The steel material according to claim 1, wherein the chemical composition contains one or more types of elements selected from the group consisting of:
Ca: 0.0001 to 0.0100%,
Mg: 0.0001 to 0.0100%,
Zr: 0.0001 to 0.0100%, and
rare earth metal: 0.0001 to 0.0100%.

4. The steel material according to claim 2, wherein the chemical composition contains one or more types of elements selected from the group consisting of:
Ca: 0.0001 to 0.0100%,
Mg: 0.0001 to 0.0100%,
Zr: 0.0001 to 0.0100%, and
rare earth metal: 0.0001 to 0.0100%.

5. The steel material according to claim 1, wherein the chemical composition contains one or more types of elements selected from the group consisting of:
Co: 0.02 to 0.50%, and
W: 0.02 to 0.50%.

6. The steel material according to claim 2, wherein the chemical composition contains one or more types of elements selected from the group consisting of:
Co: 0.02 to 0.50%, and
W: 0.02 to 0.50%.

7. The steel material according to claim 3, wherein the chemical composition contains one or more types of elements selected from the group consisting of:
Co: 0.02 to 0.50%, and
W: 0.02 to 0.50%.

8. The steel material according to claim 4, wherein the chemical composition contains one or more types of elements selected from the group consisting of:
Co: 0.02 to 0.50%, and
W: 0.02 to 0.50%.

9. The steel material according to claim 1, wherein the chemical composition contains one or more types of elements selected from the group consisting of:
Ni: 0.01 to 0.10%, and
Cu: 0.01 to 0.50%.

10. The steel material according to claim 2, wherein the chemical composition contains one or more types of elements selected from the group consisting of:
Ni: 0.01 to 0.10%, and
Cu: 0.01 to 0.50%.

11. The steel material according to claim 3, wherein the chemical composition contains one or more types of elements selected from the group consisting of:
Ni: 0.01 to 0.10%, and
Cu: 0.01 to 0.50%.

12. The steel material according to claim 4, wherein the chemical composition contains one or more types of elements selected from the group consisting of:
Ni: 0.01 to 0.10%, and
Cu: 0.01 to 0.50%.

13. The steel material according to claim 5, wherein the chemical composition contains one or more types of elements selected from the group consisting of:
Ni: 0.01 to 0.10%, and
Cu: 0.01 to 0.50%.

14. The steel material according to claim 6, wherein the chemical composition contains one or more types of elements selected from the group consisting of:
Ni: 0.01 to 0.10%, and
Cu: 0.01 to 0.50%.

15. The steel material according to claim 7, wherein the chemical composition contains one or more types of elements selected from the group consisting of:
Ni: 0.01 to 0.10%, and
Cu: 0.01 to 0.50%.

16. The steel material according to claim 8, wherein the chemical composition contains one or more types of elements selected from the group consisting of:
Ni: 0.01 to 0.10%, and
Cu: 0.01 to 0.50%.

17. The steel material according to claim 1, wherein:
the steel material is an oil-well steel pipe.

* * * * *